US008774364B2

(12) United States Patent
Aoki et al.

(10) Patent No.: US 8,774,364 B2
(45) Date of Patent: Jul. 8, 2014

(54) X-RAY GENERATING APPARATUS AND METHOD OF DRIVING X-RAY TUBE

(75) Inventors: Shuji Aoki, Yokohama (JP); Takao Ogura, Sagamihara (JP); Yasue Sato, Machida (JP); Miki Tamura, Kawasaki (JP); Kazuyuki Ueda, Tokyo (JP); Ichiro Nomura, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 369 days.

(21) Appl. No.: 13/286,352

(22) Filed: Nov. 1, 2011

(65) Prior Publication Data

US 2012/0121069 A1 May 17, 2012

(30) Foreign Application Priority Data

Nov. 17, 2010 (JP) ..... 2010-256793

(51) Int. Cl.
*H05G 1/12* (2006.01)

(52) U.S. Cl.
CPC ..... *H05G 1/12* (2013.01)
USPC ..... 378/104

(58) Field of Classification Search
CPC ..... H01J 2237/049; H01J 2237/063; H01J 2235/062; H01J 2237/0473; H01J 2237/0475; H01J 2237/083; H01J 2237/06341; H01J 2237/1501; H01J 2237/151; H01J 2237/24415; H01J 29/62; H01J 35/06; H01J 37/06; H01J 35/065; H01J 35/14; H01J 2237/04; H01J 35/08; H01J 2229/4813; H01J 2235/186; H01J 2237/06316; H01J 37/09; H01J 37/12; H01J 37/243; H01J 35/045; H05G 1/46; H05G 1/12; H05G 1/20
USPC ..... 378/98.8, 101–114
See application file for complete search history.

(56) References Cited

U.S. PATENT DOCUMENTS

| | | | | |
|---|---|---|---|---|
| 7,133,495 | B2 | 11/2006 | Nakamura et al. | 378/114 |
| 2004/0114722 | A1* | 6/2004 | Shimono | 378/138 |
| 2011/0235783 | A1 | 9/2011 | Ogura et al. | 378/112 |

FOREIGN PATENT DOCUMENTS

| | | |
|---|---|---|
| JP | 2002-299098 | 10/2002 |
| JP | 2003-317996 | 11/2003 |

* cited by examiner

*Primary Examiner* — Toan Ton
*Assistant Examiner* — John Corbett
(74) *Attorney, Agent, or Firm* — Fitzpatrick, Cella, Harper & Scinto

(57) ABSTRACT

An inverter circuit is shared by respective drive circuits that supply a predetermined voltage to a lens electrode and a grid electrode, or to a lens electrode and a cathode electrode. A DC voltage obtained by full-wave rectifying a pulse train output from the inverter circuit is supplied to the lens electrode, a DC voltage obtained by half-wave rectifying a pulse train output from the inverter circuit is supplied to the grid electrode or cathode electrode. At times of a first operation and a last operation of the inverter circuit during a period of generating X-rays, operations of the inverter circuit are controlled such that a trans circuit outputs a negative polarity voltage to the full-wave rectifying circuit and the half-wave rectifying circuit, respectively.

12 Claims, 10 Drawing Sheets

X-RAY GENERATING APPARATUS AND METHOD OF DRIVING X-RAY TUBE

BACKGROUND OF THE INVENTION

1. Field of the Invention

The present invention relates to an X-ray generating apparatus that generates X-rays, and a method of driving an X-ray tube that the X-ray generating apparatus includes.

2. Description of the Related Art

Conventionally, X-ray tubes that generate X-rays are configured to use a reflection type target or a transmission type target. Both of these configurations cause electrons emitted from an electron source to collide with a target to generate X-rays from the target by means of the collision energy. The generated X-rays pass through a transmission window provided in the X-ray tube and are emitted to outside.

Generally, an X-ray tube includes an electron source that emits electrons, a lens electrode that focuses electrons emitted from the electron source, and a target that generates X-rays when electrons collide therewith. An electron source includes a grid electrode that draws out electrons from an electron emission source such as a filament (in the case of a directly heated electron source) or a cathode electrode (in the case of an indirectly heated electron source). A required voltage is supplied to the filament, the cathode electrode, the grid electrode, the lens electrode, the target or the like, respectively, from an external drive circuit.

Further, for example, in an X-ray tube that uses a transmission type target as a target, when electrons collide with the transmission type target, X-rays are radiated in all directions from the collision region. Therefore, a rearward shielding member is provided on the lens electrode side of the transmission type target and a forward shielding member is provided on the transmission window side of the transmission type target. By providing the rearward shielding member and the forward shielding member, radiation of X-rays in unnecessary directions is suppressed.

Normally, in an X-ray tube, it is necessary to control the order of applying the respective voltages to the electron emission source, the grid electrode, the lens electrode and the target when generating X-rays. Furthermore, when stopping the generation of X-rays, it is necessary to control the order of stopping application of each voltage to the electron emission source, the grid electrode, the lens electrode and the target.

For example, when emitting X-rays, a filament or a heater is preheated by applying a predetermined voltage thereto, and a voltage (first voltage) for not allowing thermal electrons emitted from the electron emission source to reach the target is applied to the grid electrode and lens electrode. Subsequently, at a time of actually generating X-rays, first, a predetermined high voltage is applied to the target. Next, a voltage (second voltage) for focusing electrons emitted from the electron emission source is applied to the lens electrode, and finally a voltage (second voltage) for drawing out electrons from the electron emission source is applied to the grid electrode. In this connection, preheating of the filament or the heater is necessary in order to stably emit X-rays simultaneously with the input of an instruction to irradiate X-rays (application of a second voltage to the grid electrode).

In contrast, when stopping the emission of X-rays, the applied voltage is switched from the second voltage to the first voltage in the order of the grid electrode and the lens electrode, thereafter the application of a high voltage to the target is stopped, and finally application of a voltage to the filament or heater is stopped.

In this case, for example, if the second voltage is applied to the grid electrode in a state in which the high voltage is not being applied to the target, electrons that are drawn out from the electron emission source collide with a member other than the target (such as the lens electrode or the rearward shielding member). There is thus a risk that unwanted X-rays will be unintentionally generated. At that time, if the second voltage is being applied to the lens electrode, since the electrons that are drawn out from the electron emission source are focused, collision of the electrons with the rearward shielding member can be suppressed. However, in that case, most of the electrons drawn out from the electron emission source flow into the lens electrode, and hence an overcurrent flows through the lens electrode or a drive circuit thereof. If a state in which an overcurrent flows through the lens electrode or a drive circuit continues for a long time, there is a risk that the lens electrode or the drive circuit will be damaged.

Therefore, according to the conventional X-ray generating apparatus, to enable control of the order of applying and the order of stopping application of voltages to a filament (or heater), a grid electrode, a lens electrode and a target of an X-ray tube, each voltage is generated by an independent drive circuit, respectively.

Japanese Patent Application Laid-Open No. 2002-299098 discloses an X-ray generating apparatus in which a filament or a heater that heats a cathode electrode that is used as an electron emission source is preheated, and thereafter a voltage is applied to a grid electrode.

As described above, according to the conventional X-ray generating apparatus, the respective voltages applied to the filament (or heater), the grid electrode, the lens electrode and the target of an X-ray tube, are generated by independent drive circuits, respectively. Therefore, the scale of the drive circuits of an X-ray tube is large, and this has been a factor that has inhibited a reduction in the size of X-ray generating apparatuses.

An object of the present invention is to provide an X-ray generating apparatus that can be reduced in size compared to conventional X-ray generating apparatuses, and a method of driving an X-ray tube.

SUMMARY OF THE INVENTION

According to a first aspect of the present invention, an x-ray generating apparatus for generating an X-ray from a target by colliding an electron emitted from an electron source with the target through a grid electrode and a lens electrode comprises: a DC power source unit for generating a predetermined DC voltage; an inverter circuit for generating a pulse train based on the DC voltage outputted from the DC power source unit; a trans circuit for converting a voltage of the pulse train into a predetermined voltage and outputting the converted pulse train; a full-wave rectifying circuit for full-wave rectifying the pulse train outputted from the trans circuit, and supplying the full-wave rectified pulse train to the lens electrode; a half-wave rectifying circuit for half-wave rectifying the pulse train outputted from the trans circuit, and supplying the half-wave rectified pulse train to the grid electrode; and a control circuit for controlling an operation of the inverter circuit such that the trans circuit outputs a negative polarity voltage to the full-wave rectifying circuit and the half-wave rectifying circuit at times of first and last operations of the inverter circuit during a period of generating the X-ray.

According to a second aspect of the present invention, an x-ray generating apparatus for generating an X-ray from a target by colliding an electron emitted from an electron source with the target through a cathode electrode and a lens electrode comprises: a DC power source unit for generating a predetermined DC voltage; an inverter circuit for generating a pulse train based on the DC voltage outputted from the DC power source unit; a trans circuit for converting a voltage of the pulse train into a predetermined voltage and outputting the converted pulse train; a full-wave rectifying circuit for full-wave rectifying the pulse train outputted from the trans circuit, and supplying the full-wave rectified pulse train to the lens electrode; a half-wave rectifying circuit for half-wave rectifying the pulse train outputted from the trans circuit, and supplying the half-wave rectified pulse train to the cathode electrode; and a control circuit for controlling an operation of the inverter circuit such that the trans circuit outputs a positive polarity voltage to the full-wave rectifying circuit and the half-wave rectifying circuit at times of first and last operations of the inverter circuit during a period of generating the X-ray.

According to a third aspect of the present invention, a method of driving an X-ray tube which generates an X-ray from a target by colliding an electron emitted from an electron source with the target through a grid electrode and a lens electrode comprises step of: generating a predetermined DC voltage; generating a pulse train based on the DC voltage; converting a voltage of the pulse train into a predetermined voltage and outputting the converted pulse train; full-wave rectifying the converted pulse train, and supplying the full-wave rectified pulse train to the lens electrode; half-wave rectifying the converted pulse train, and supplying the half-wave rectified pulse train to the grid electrode; and controlling the generating the pulse train such that, in the converting step, a negative polarity voltage is outputted in the full-wave rectifying step and the half-wave rectifying step at times of first and last operations in the step of generating the pulse train during a period of generating the X-ray.

According to a fourth aspect of the present invention, a method of driving an X-ray tube which generates an X-ray from a target by colliding an electron emitted from an electron source with the target through a cathode electrode and a lens electrode comprises step of: generating a predetermined DC voltage; generating a pulse train based on the DC voltage; converting a voltage of the pulse train into a predetermined voltage and outputting the converted pulse train; full-wave rectifying the converted pulse train, and supplying the full-wave rectified pulse train to the lens electrode; half-wave rectifying the converted pulse train, and supplying the half-wave rectified pulse train to the cathode electrode; and controlling the generating the pulse train such that, in the converting step, a positive polarity voltage is outputted in the full-wave rectifying step and the half-wave rectifying step at times of first and last operations in the step of generating the pulse train during a period of generating the X-ray.

According to the above described X-ray generating apparatus and method of driving an X-ray tube, an inverter circuit of respective drive circuits that supply a predetermined voltage to a grid electrode and a lens electrode, or to a cathode electrode and a lens electrode can be shared. Therefore, the scale of the drive circuits of the X-ray tube can be reduced.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

(First Embodiment)

Figure 1:
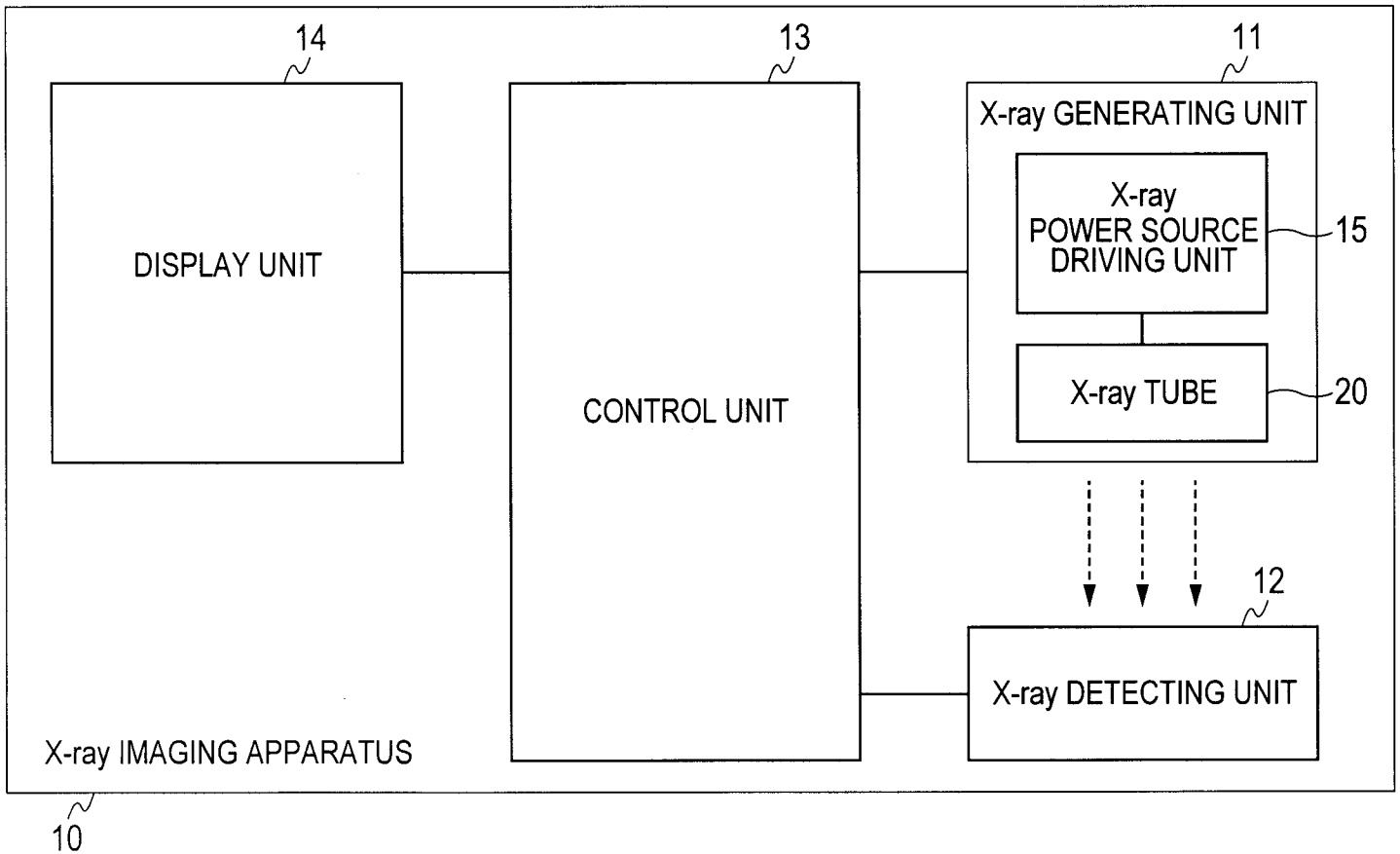
FIG. 1 is a block diagram that illustrates a configuration example of an X-ray imaging apparatus including an X-ray generating apparatus according to the present invention.

FIG. 1 is a block diagram that illustrates a configuration example of an X-ray imaging apparatus including an X-ray generating apparatus according to the present invention.

As shown in FIG. 1, an X-ray imaging apparatus 10 includes an X-ray generating apparatus 11, an X-ray detecting unit 12, a control unit 13, and a display unit 14.

The X-ray generating apparatus 11 generates X-rays and irradiates the X-rays at an object (for example, a human body) in accordance with an instruction of the control unit 13. The X-ray generating apparatus 11 includes an X-ray tube 20 that generates X-rays, and an X-ray power source driving unit 15 that supplies required electric power to each electrode of the X-ray tube 20. The X-ray tube 20 is, for example, an electron tube that causes electrons emitted from an electron source to collide with a transmission type target to generate X-rays from the transmission type target. The X-ray power source driving unit 15 supplies required electric power to a filament (or a heater), a grid electrode, a lens electrode, a transmission type target and the like of the X-ray tube 20, respectively, in accordance with an instruction of the control unit 13.

The X-ray detecting unit 12 detects X-rays that are emitted from the X-ray generating apparatus 11 and transmitted through the object. Thus, an X-ray image of the object can be imaged.

The display unit 14 displays an X-ray image of the object that is detected by the X-ray detecting unit 12.

The control unit 13 controls operations of the X-ray generating apparatus 11, the X-ray detecting unit 12 and the display unit 14. For example, the control unit 13 controls X-ray imaging of an object by the X-ray generating apparatus 11 and the X-ray detecting unit 12. Further, the control unit 13 displays a radiographic image of an object detected by the X-ray detecting unit 12 on the display unit 14. In this connection, the X-ray detecting unit 12 and the display unit 14 shown in FIG. 1 need not be provided inside the X-ray imaging apparatus 10, and may each be an independent apparatus.

The control unit 13 shown in FIG. 1 can be realized, for example, by one or a plurality of computers. The computer includes a main control unit such as a CPU, and a memory unit such as a ROM (Read Only Memory) or a RAM (Random Access Memory). The computer realizes the functions of the aforementioned control unit 13 by executing predetermined processing by means of the main control unit in accordance with a program stored in the memory unit. The computer may also include a communication unit such as a network card and an input unit such as a keyboard, a display or a touch panel.

Figure 2:
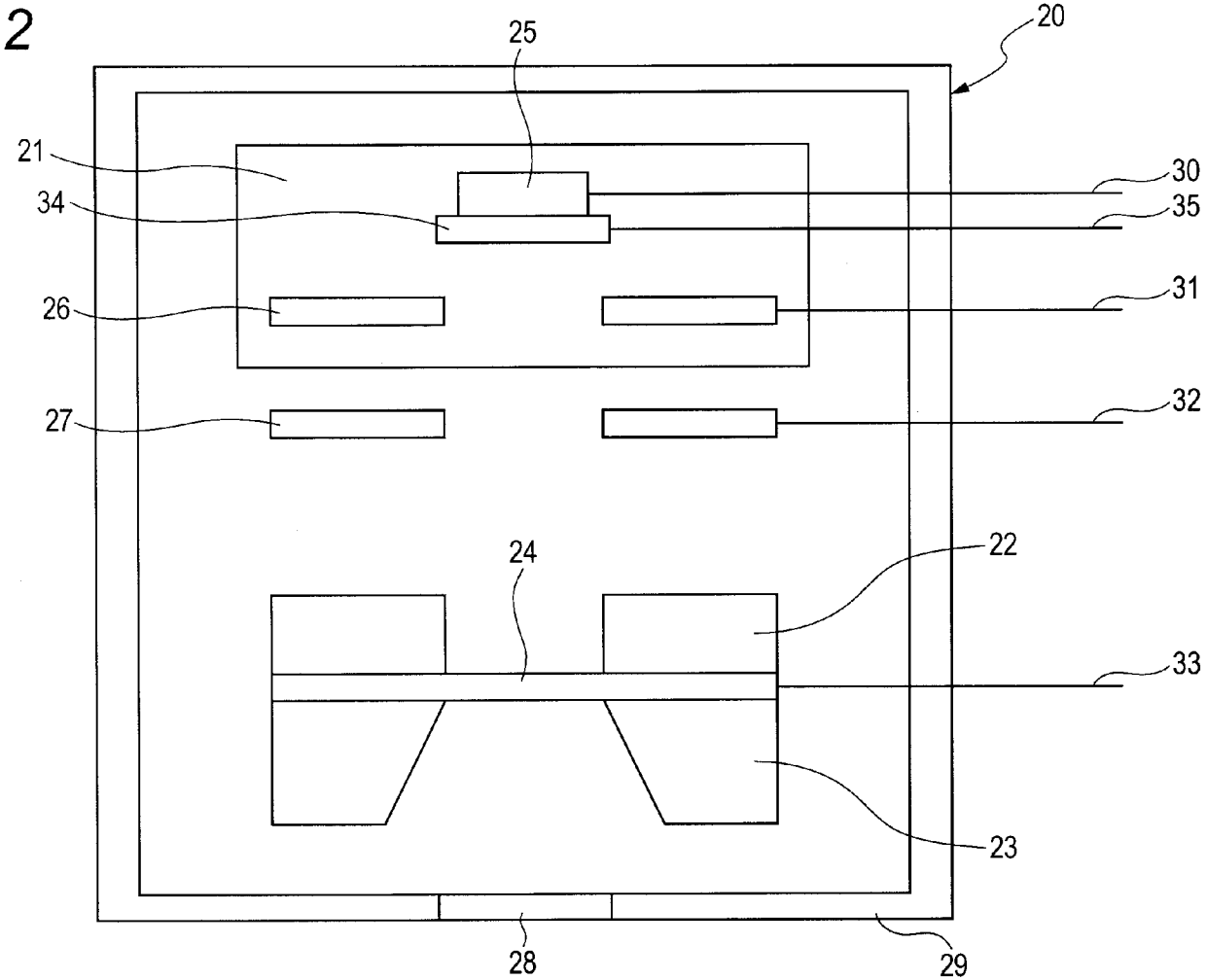
FIG. 2 is a schematic diagram that illustrates a configuration example of an X-ray tube shown in FIG. 1.

Next, the X-ray tube 20 shown in FIG. 1 is described using FIG. 2.

FIG. 2 is a schematic diagram that illustrates a configuration example of the X-ray tube shown in FIG. 1.

As shown in FIG. 2, the X-ray tube 20 includes an electron source 21, a lens electrode 27, a rearward shielding member 22, a forward shielding member 23, a transmission type target 24 and a vacuum container 29. As described above, the X-ray tube 20 emits electrons from the electron source 21, focuses the electrons using the lens electrode 27, and causes the electrons to collide with the transmission type target 24 to generate X-rays.

The vacuum container 29 is an envelope that maintains the inside of the X-ray tube 20 that includes the electron source 21, the lens electrode 27, the rearward shielding member 22, the forward shielding member 23 and the transmission type target 24 in a vacuum state. The vacuum container 29 can maintain the inside of the X-ray tube 20 at a degree of vacuum on the order of $10^{-5}$ Pa, and is formed of glass, metal, ceramic or the like. An X-ray transmission window 28 that is an opening that transmits X-rays is formed in the vacuum container 29. For example, a light element material such as aluminum or beryllium, or a ceramic material such as glass is used for the X-ray transmission window 28.

The electron source 21 includes a filament 25 as an electron emission source that emits thermal electrons, a grid electrode 26 for drawing out thermal electrons from the filament 25, and a cathode electrode 34 that regulates the electric potential of the electron source 21. The filament 25 and the cathode electrode 34 are insulated.

A hot cathode such as the filament 25 or an impregnated cathode electrode may be used as the electron emission source, or a cold cathode such as a carbon nanotube may also be used. When using an impregnated cathode electrode as the electron emission source, thermal electrons may be emitted from the cathode electrode by heating an unshown heater by applying a predetermined voltage thereto.

A predetermined voltage is supplied to the filament 25 through a wire 30 to heat the filament 25. A predetermined reference voltage that regulates the potential of the electron source 21 is applied to the cathode electrode 34 through a wire 35. A first voltage that is a voltage that does not cause electrons to be emitted from the electron source 21 or a second voltage that is a voltage for causing the emission of electrons is applied to the grid electrode 26 through a wire 31. The first voltage is a voltage that has the same potential as the electron source 21 or a voltage that has a lower potential (negative voltage) than the electron source 21. The second voltage is a voltage that has a higher potential than the electron source 21. According to the present embodiment, the electron source 21 has the same potential as the cathode electrode 34.

The lens electrode 27 is provided between the electron source 21 and the rearward shielding member 22, and focuses electrons that are emitted from the electron source 21 to form an electron beam by means of a lens action. A first voltage that is a voltage that does not produce a lens action or a second voltage that is a voltage that produces a lens action is applied through a wire 32 to the lens electrode 27. The first voltage is a voltage that has the same potential as the electron source 21 or a voltage that has a lower potential (negative voltage) than the electron source 21. The second voltage is a voltage that has a higher potential than the electron source 21.

The rearward shielding member 22 is provided on the electron source 21 side (rearward) of the transmission type target 24. An opening that electrons emitted from the electron source 21 pass through is provided in the rearward shielding member 22. The rearward shielding member 22 blocks X-rays that are radiated towards the rear among the X-rays that are radiated in all directions from the transmission type target 24 when electrons collide therewith.

The forward shielding member 23 is provided on the X-ray transmission window 28 side (forward) of the transmission type target 24. An opening that X-rays generated from the transmission type target 24 pass through is provided in the forward shielding member 23. The forward shielding member 23 blocks X-rays that are radiated towards the front at areas other than the X-ray transmission window 28 among the X-rays that are radiated in all directions from the transmission type target 24 when electrons collide therewith.

The transmission type target 24 generates X-rays when electrons collide therewith. At a time of generating X-rays, a predetermined high voltage (for example, a DC voltage of 100 kV) based on the potential of the electron source 21 is applied to the transmission type target 24 through a wire 33. A material that has a high melting point and favorable X-ray generation efficiency, for example, a heavy metal such as tungsten (W) or tantalum (Ta), is used for the transmission type target 24. A voltage applied to the transmission type target 24 differs according to the purpose of use of the X-ray tube 20 and the material of the transmission type target 24. For example, when the transmission type target 24 is formed of tungsten and the X-ray tube 20 is employed for medical use, the voltage is from 80 to 110 kV.

Figure 3:
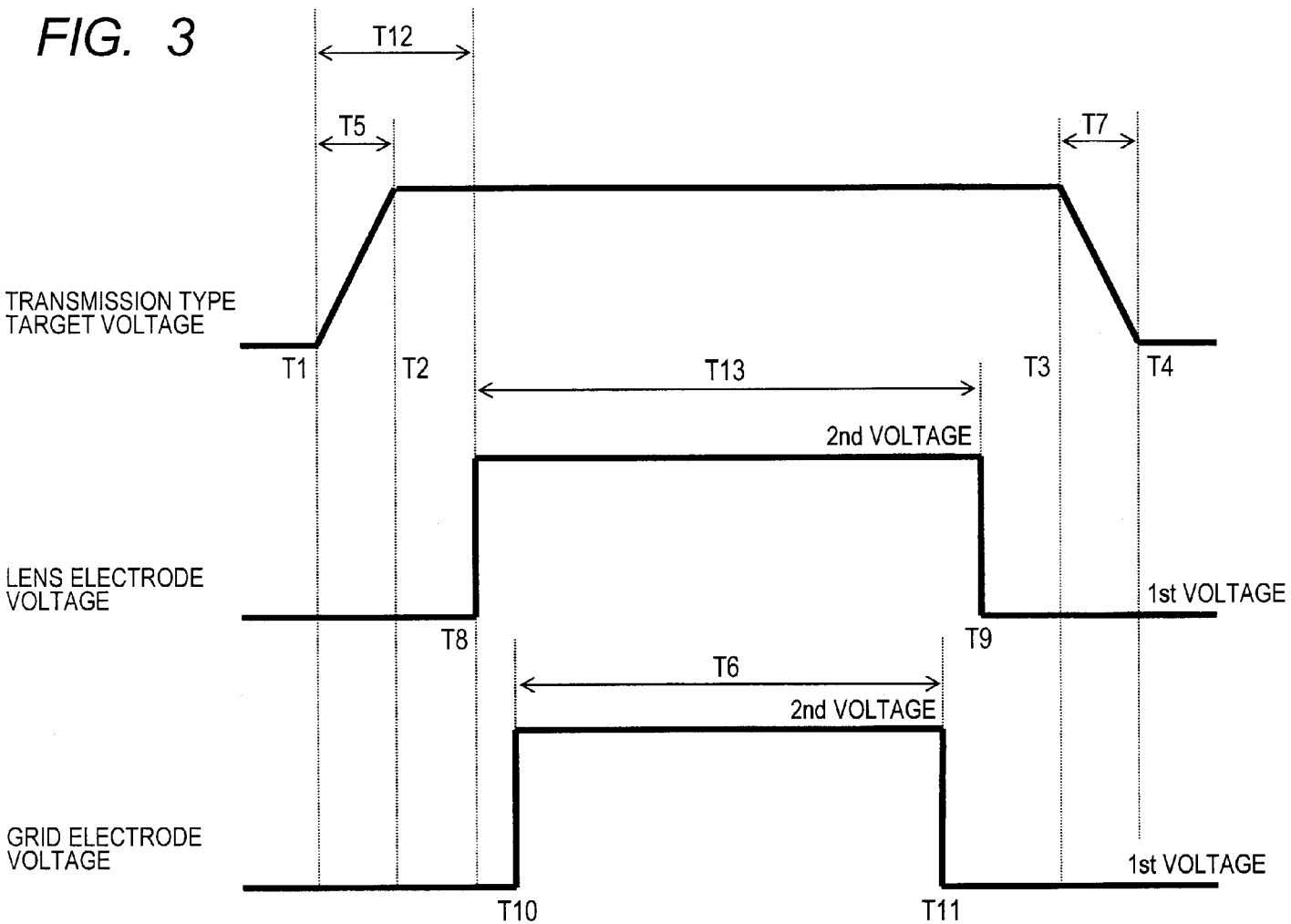
FIG. 3 is a waveform diagram that illustrates an example of a method of driving an X-ray tube according to a first embodiment.

Next, a method of driving the X-ray tube 20 according to the first embodiment is described using FIG. 3.

FIG. 3 is a waveform diagram that illustrates an example of a method of driving the X-ray tube according to the first embodiment.

FIG. 3 illustrates the timing of applying a high voltage to the transmission type target 24, and timings of applying a first voltage and a second voltage to the grid electrode 26 and the lens electrode 27, respectively. The emission of electrons from the electron source 21 and stopping the emission of electrons therefrom is controlled by means of an applied voltage to the grid electrode 26. Note that the lateral direction in FIG. 3 represents a time axis. Applied voltages to the transmission type target 24, the lens electrode 27 and the grid electrode 26 shown in FIG. 3 are controlled by means of the X-ray power source driving unit 15 in accordance with an instruction of the control unit 13 that is shown in FIG. 1.

For example, when the main power source of the X-ray imaging apparatus 10 is turned on, the control unit 13 applies a first voltage to the grid electrode 26 and applies a first voltage to the lens electrode 27 by means of the X-ray power source driving unit 15. Further, the control unit 13 applies a predetermined voltage to the filament 25 to heat the filament 25 in advance so that thermal electrons are stably emitted from the electron source 21 at a time of generating X-rays. Heating of the filament 25 is started prior to starting application of a high voltage to the transmission type target 24, and heating of the filament 25 is stopped after stopping application of a high voltage to the transmission type target 24.

As shown in FIG. 3, first, at a time point T1, the control unit 13 applies a high voltage (predetermined voltage) to the transmission type target 24 by means of the X-ray power source driving unit 15. Time is required from the start of applying a voltage to the transmission type target 24 until the applied voltage reaches a predetermined high voltage (period T5). The control unit 13 can hold information regarding the period T5 in advance, and can determine the application timing with respect to the lens electrode 27 and the grid electrode 26. The applied voltage with respect to the transmission type target 24 reaches the predetermined high voltage at a time point T2.

When the applied voltage of the transmission type target 24 reaches the predetermined high voltage, at a time point T8, the control unit 13 applies a second voltage to the lens electrode 27 by means of the X-ray power source driving unit 15. Next, at a time point T10, the control unit 13 applies the second voltage to the grid electrode 26 to cause the emission of electrons from the electron source 21 and generate X-rays in the X-ray tube 20.

When a required X-ray generating period (period T6) elapses, at a time point T11, the control unit 13 switches the applied voltage of the grid electrode 26 from the second voltage to the first voltage by means of the X-ray power source driving unit 15 to stop emission of electrons from the electron source 21. Next, at a time point T9, the control unit 13 switches the applied voltage of the lens electrode 27 from the second voltage to the first voltage. Thereafter, at a time point T3, the control unit 13 stops application of a voltage to the transmission type target 24. At such time, the time point when the applied voltage of the transmission type target 24 actually returns to the original voltage (potential of the electron source 21) is a time point T4.

In this case, although a voltage is applied to the transmission type target 24 in the period T5 (T1 to T2), X-rays are not generated because electrons are not emitted from the electron source 21. In contrast, in the period T6 (T10 to T11), since the predetermined high voltage is applied to the transmission type target 24 and the second voltage is applied to the lens electrode 27 and the grid electrode 26, X-rays are emitted from the X-ray transmission window 28. The period T6 is set to, for example, a period of approximately 10 msec to 1 sec. Since the emission of electrons from the electron source 21 stops at the time point T11, the time point T3 (timing of stopping application of a voltage to the transmission type target 24) may be set to a time point from the time point T11 onward.

As described above, when the second voltage is applied to the grid electrode 26 between the time point T1 and the time point T2, electrons emitted from the electron source 21 collide with the lens electrode 27 and the rearward shielding member 22 and the like, and unwanted X-rays are generated. However, even in that case, if the second voltage is applied to the lens electrode 27, since most of the electrons do not collide with the rearward shielding member 22, generation of unwanted X-rays is suppressed. Therefore, unwanted X-rays do not leak to outside of the vacuum container 29.

Further, when the first voltage that is applied to the lens electrode 27 is set lower than the potential of the electron source 21, even if the second voltage is applied to the grid electrode 26 between the time point T1 and the time point T2, electrons emitted from the electron source 21 are returned to the electron source 21 side by the lens electrode 27. Accordingly, in that case also, generation of unwanted X-rays is suppressed.

Figure 4:
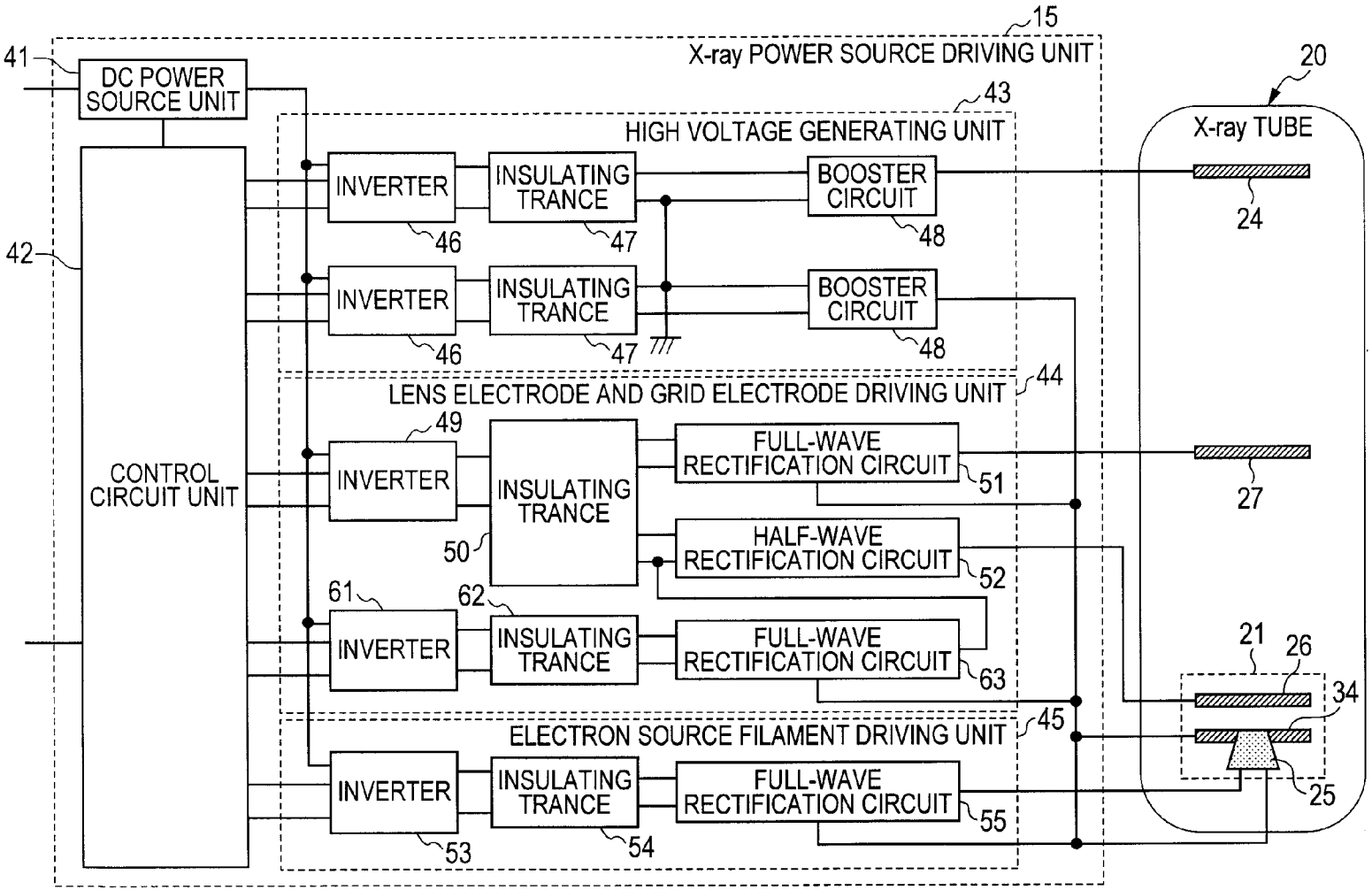
FIG. 4 is a block diagram that illustrates a configuration example of an X-ray generating apparatus according to the first embodiment.

Next, the configuration of the X-ray generating apparatus according to the first embodiment is described using FIG. 4.

FIG. 4 is a block diagram that illustrates a configuration example of the X-ray generating apparatus according to the first embodiment.

As shown in FIG. 4, the X-ray generating apparatus 11 includes the X-ray power source driving unit 15 and the X-ray tube 20.

The X-ray power source driving unit 15 includes a DC power source unit 41, a control circuit unit 42, a high voltage generating unit 43, a lens electrode and grid electrode driving unit 44 and an electron source filament driving unit 45.

The DC power source unit 41 receives electric power from an external DC power supply or AC power supply, and supplies a predetermined DC voltage to the control circuit unit 42, the high voltage generating unit 43, the lens electrode and grid electrode driving unit 44 and the electron source filament driving unit 45.

In accordance with instructions from the control unit 13 (see FIG. 1), the control circuit unit 42 controls operations of the high voltage generating unit 43, the lens electrode and grid electrode driving unit 44 and the electron source filament driving unit 45.

The high voltage generating unit 43 includes inverter circuits 46, trans circuits 47 and booster circuits 48, and generates a DC voltage (approximately ±50 kV) that takes the potential of the electron source 21 as a reference potential (for example, −50 kV), that is supplied to the transmission type target 24. In accordance with control performed by the control circuit unit 42, each inverter circuit 46, for example, converts a DC voltage supplied from the DC power source unit 41 into an AC voltage with a frequency from several kHz to several tens of kHz and a peak voltage of approximately 100 V. An AC voltage output from the inverter circuit 46 is supplied to the booster circuit 48 through the trans circuit 47. The booster circuit 48 boosts the AC voltage that is output from the inverter circuit 46, and converts the AC voltage to a DC voltage of approximately 100 kV. The output voltage of the booster circuit 48 is supplied to the transmission type target 24 and the cathode electrode 34.

The lens electrode and grid electrode driving unit 44 includes inverter circuits 49 and 61, trans circuits 50 and 62, full-wave rectifying circuits 51 and 63 and a half-wave rectifying circuit 52. The lens electrode and grid electrode driving unit 44 generates DC voltages (first voltage and second voltage) that take the potential of the electron source 21 as a reference potential (for example, −50 kV), that are supplied to the lens electrode 27 and the grid electrode 26. The inverter circuit 49, the trans circuit 50, the full-wave rectifying circuit 51 and the half-wave rectifying circuit 52 generate a second voltage that is supplied to the lens electrode 27 and the grid electrode 26. The inverter circuit 61, the trans circuit 62 and the full-wave rectifying circuit 63 generate a bias voltage for setting the output voltage of the half-wave rectifying circuit 52 to the first voltage when the second voltage is not being applied to the grid electrode 26. Hereinafter, the inverter circuit 61, the trans circuit 62 and the full-wave rectifying circuit 63 are referred to as a "bias circuit". The first voltage that is supplied to the lens electrode 27, for example, is set to the same potential as the electron source 21.

In accordance with control performed by the control circuit unit 42, the inverter circuit 49, for example, converts a DC voltage supplied from the DC power source unit 41 into an AC voltage (pulse train) with a frequency from several kHz to several tens of kHz and a peak voltage of approximately 100 V. A pulse train that is output from the inverter circuit 49 is input into the, for example, one-input, two-output type trans circuit 50 that receives the pulse train as an input and can output pulse trains of different voltages to the full-wave rectifying circuit 51 and the half-wave rectifying circuit 52. The trans circuit 50 outputs a pulse train with a peak voltage of approximately 2 kV for the lens electrode 27, and outputs a pulse train with a peak voltage of approximately 200 V for the grid electrode 26. In this connection, the trans circuit 50 is not limited to a one-input, two-output type trans circuit, and a configuration may be adopted in which two one-input, one-output type trans circuits 50 are provided in correspondence with the full-wave rectifying circuit 51 and the half-wave rectifying circuit 52. If a one-input, two-output type trans circuit is provided as the trans circuit 50, the circuit scale of the lens electrode and grid electrode driving unit 44 can be made smaller.

The pulse train of approximately 2 kV for the lens electrode 27 is converted into a DC voltage of approximately 1 kV by the full-wave rectifying circuit 51, and is supplied as a second voltage to the lens electrode 27. The first voltage that is supplied to the lens electrode 27 may have the same potential as the cathode electrode 34 as described above. The first voltage that is supplied to the lens electrode 27 may also be set to a negative voltage by, for example, providing a circuit that is the same as the above described bias circuit, and adding a voltage generated in the bias circuit to the output voltage of the full-wave rectifying circuit 51.

The pulse train of approximately 200 V for the grid electrode 26 is converted into a DC voltage of approximately 100 V by the half-wave rectifying circuit 52, and is supplied as a second voltage to the grid electrode 26. The first voltage that is applied to the grid electrode 26 is generated by generating a DC voltage of approximately −70 V by means of the bias circuit, and adding that DC voltage to the output voltage of the half-wave rectifying circuit 52.

The inverter circuit 61 of the bias circuit, for example, converts a DC voltage supplied from the DC power source unit 41 to an AC voltage with a frequency from several kHz to several tens of kHz and a peak voltage of approximately 100 V. The AC voltage that is output from the inverter circuit 61 is converted to an AC voltage of approximately 140 V by the trans circuit 62. The AC voltage that is output from the trans circuit 62 is converted to a DC voltage of approximately −70 V by the full-wave rectifying circuit 63, and added to the output voltage of the half-wave rectifying circuit 52.

The electron source filament driving unit 45 includes an inverter circuit 53, a trans circuit 54 and a full-wave rectifying circuit 55, and generates a DC voltage of approximately 10 V that is supplied to the filament 25 of the electron source 21. In accordance with control of the control circuit unit 42, the inverter circuit 53, for example, converts a DC voltage supplied from the DC power source unit 41 to an AC voltage with a frequency from several kHz to several tens of kHz and a peak voltage of approximately 100 V. The AC voltage that is output from the inverter circuit 53 is converted to an AC voltage of approximately 20 V by the trans circuit 54. The AC voltage that is output from the trans circuit 54 is converted to a DC voltage of approximately 10 V by the full-wave rectifying circuit 55, and supplied to the filament 25 of the electron source 21.

Figure 5:
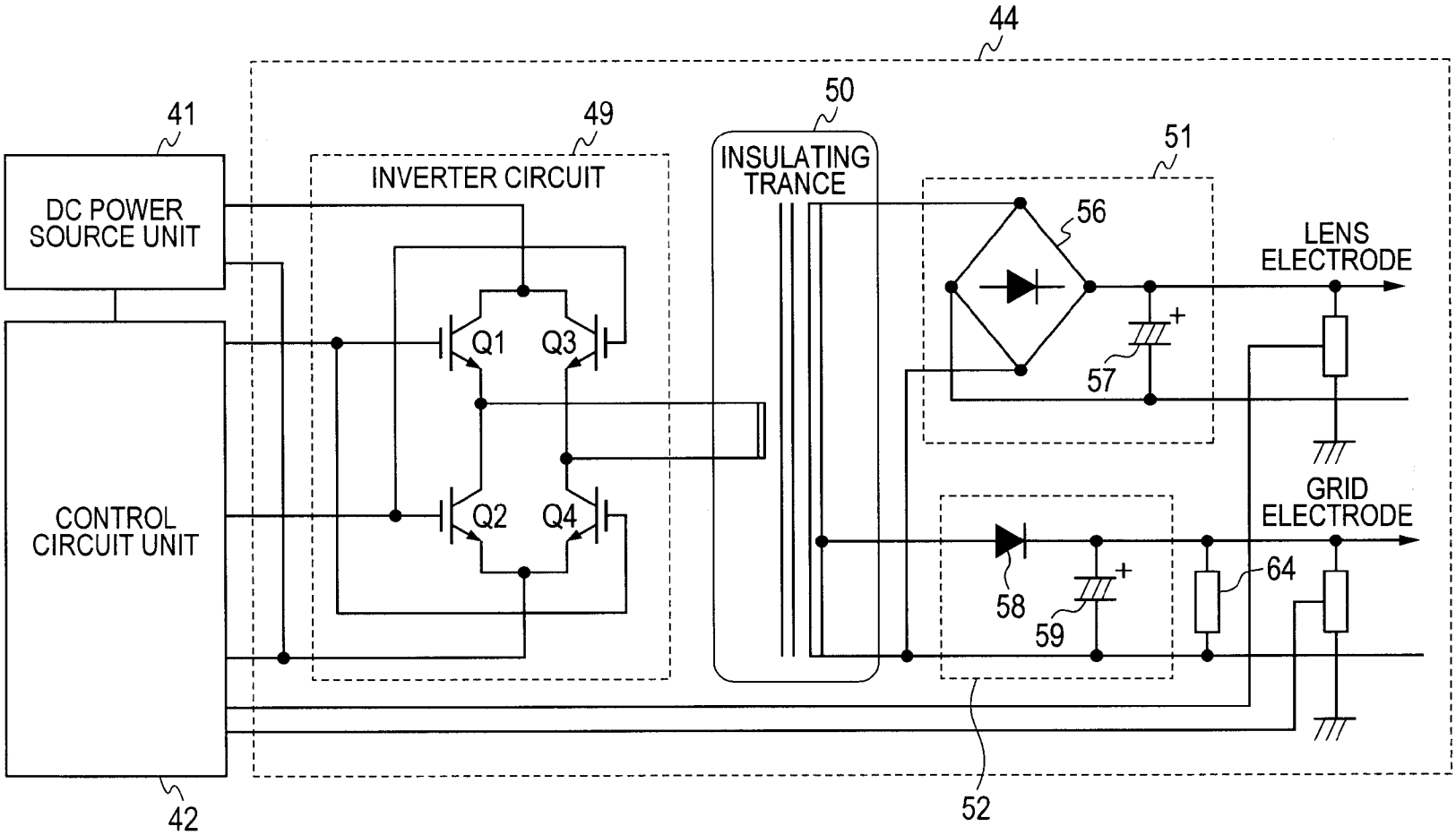
FIG. 5 is a circuit diagram that illustrates a configuration example of a lens electrode and grid electrode driving unit shown in FIG. 4.

Next, a specific configuration example of the lens electrode and grid electrode driving unit 44 illustrated in FIG. 4 is described using FIG. 5.

FIG. 5 is a circuit diagram that illustrates a configuration example of the lens electrode and grid electrode driving unit illustrated in FIG. 4.

As shown in FIG. 5, the inverter circuit 49 includes bridge-connected transistors Q1 to Q4. A DC voltage of approximately 100 V is supplied to the inverter circuit 49 from the DC power source unit 41. In the inverter circuit 49, the transistors Q1 and Q4 or the transistors Q2 and Q3 are controlled so as to turn on and off simultaneously by the control circuit unit 42. Further, in the inverter circuit 49, the transistors Q1 and Q2 and also the transistors Q3 and Q4 are controlled so as not to turn on simultaneously by the control circuit unit 42.

When the transistors Q1 and Q4 are on, a voltage of positive polarity (hereunder, referred to as "positive polarity voltage") is output from the inverter circuit 49. In contrast, when the transistors Q3 and Q2 are on, a voltage of negative polarity (hereunder, referred to as "negative polarity voltage") is output from the inverter circuit 49. Thus, the inverter circuit 49 converts a DC voltage of approximately 100 V that is supplied from the DC power source unit 41 to an AC voltage (pulse train) having an amplitude of approximately 100 V.

A pulse train that is output from the inverter circuit 49 is converted to, for example, a pulse train of approximately 2 kV for the lens electrode 27 and a pulse train of approximately 200 V for the grid electrode 26 by the one-input, two-output trans circuit 50.

The full-wave rectifying circuit 51 includes a rectifying diode bridge circuit 56 and a smoothing capacitor 57, and converts the pulse train of approximately 2 kV that is output from the trans circuit 50 to a DC voltage of approximately 1 kV. The output voltage of the full-wave rectifying circuit 51 is supplied to the lens electrode 27 as a second voltage.

The half-wave rectifying circuit 52 includes a rectifying diode 58, a smoothing capacitor 59 and a capacitor discharging resistor 64, and converts the pulse train of approximately 200 V that is output from the trans circuit 50 to a DC voltage of approximately 100 V.

Figure 6:
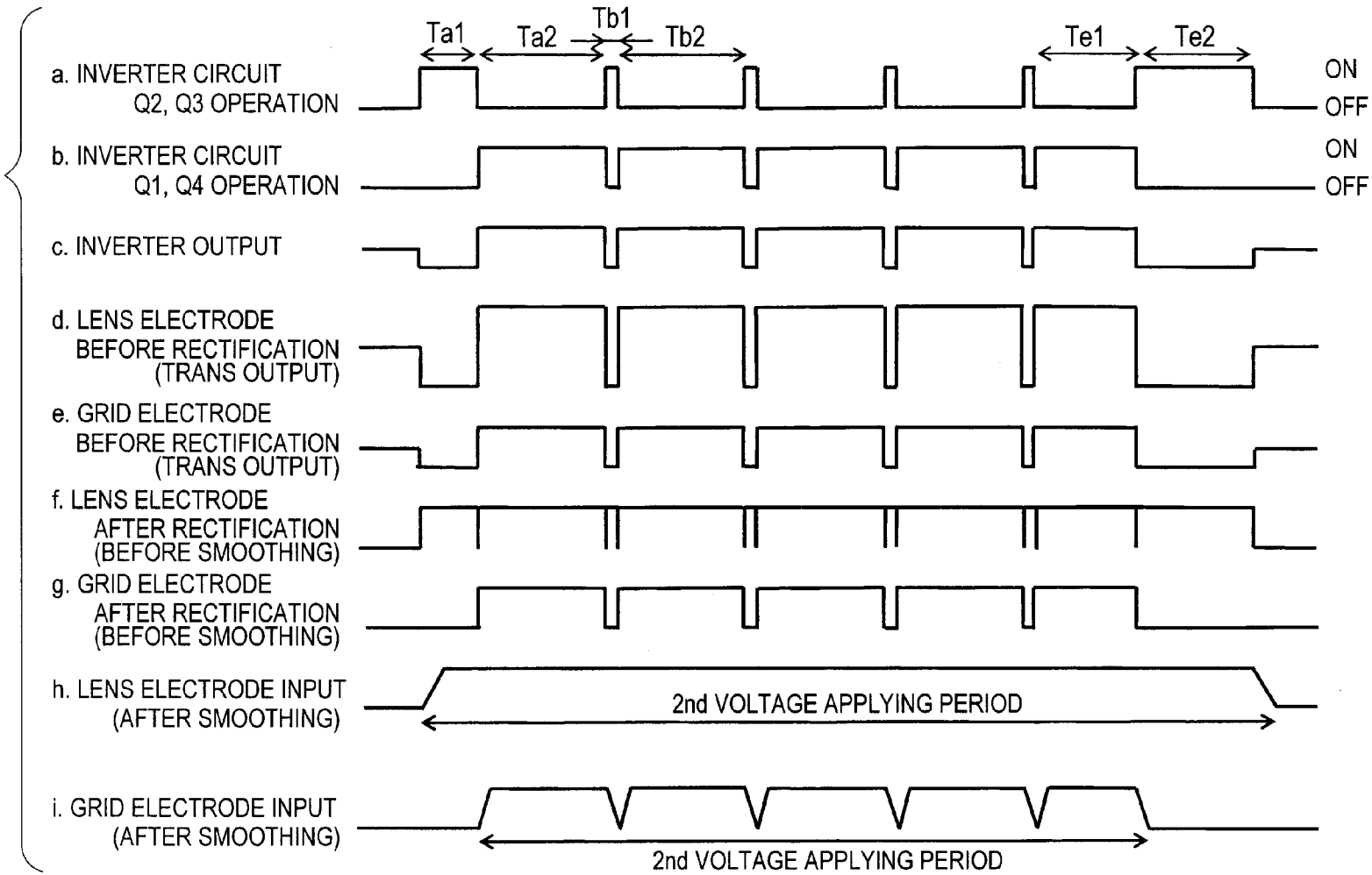
FIG. 6 is a waveform diagram that illustrates an example of operation waveforms of the lens electrode and grid electrode driving unit shown in FIG. 4.

Next, the operations of the lens electrode and grid electrode driving unit 44 of the present embodiment are described using FIG. 6.

FIG. 6 is a waveform diagram that illustrates an example of operation waveforms of the lens electrode and grid electrode driving unit illustrated in FIG. 4.

As shown in FIG. 3, according to the present embodiment, at a time of irradiating X-rays, first, the second voltage is applied to the lens electrode 27 (T8), and thereafter the second voltage is applied to the grid electrode 26 (T10). Further, when stopping irradiation of X-rays, first, the voltage applied to the grid electrode 26 is switched from the second voltage to the first voltage (T11), and thereafter the voltage applied to the lens electrode 27 is switched from the second voltage to the first voltage (T9).

As shown in FIG. 4, the lens electrode and grid electrode driving unit 44 full-wave rectifies the pulse train that is output from the inverter circuit 49 and supplies the full-wave rectified pulse train to the lens electrode 27, and also half-wave rectifies the pulse train that is output from the inverter circuit 49 and supplies the half-wave rectified pulse train to the grid electrode 26. According to the present invention, the period from T8 to T10 and the period from T11 to T9 that are described above are secured by utilizing this difference in the rectifying systems. More specifically, at times of a first operation and a last operation of the inverter circuit 49 during a period of generating X-rays, the control circuit unit 42 controls operations of the inverter circuit 49 so as to output a voltage of negative polarity to the full-wave rectifying circuit 51 and the half-wave rectifying circuit 52, respectively, from the trans circuit 50. Thus, a DC voltage (second voltage) can be output from the full-wave rectifying circuit 51 that rectifies by also utilizing a negative polarity voltage prior to the half-wave rectifying circuit 52 that rectifies without utilizing a negative polarity voltage. Further, the DC voltage that is output from the full-wave rectifying circuit 51 that rectifies by also utilizing a negative polarity voltage can be stopped after the DC voltage that is output from the half-wave rectifying circuit 52 that rectifies without utilizing a negative polarity voltage. More specifically, the second voltage can be applied to the lens electrode 27 prior to the grid electrode 26, and the applied voltage of the lens electrode 27 can be switched from the second voltage to the first voltage after the grid electrode 26. In this connection, the above described period from T8 to T10 and period from T11 to T9 can be set with a pulse width of the negative polarity voltage supplied to the full-wave rectifying circuit 51 and the half-wave rectifying circuit 52, respectively.

Further, according to the present embodiment, operations of the inverter circuit 49 are controlled such that, during a period of generating X-rays except for the above described period from T8 to T10 and period from T11 to T9, a period of positive polarity voltage of the pulse train output from the trans circuit 50 to the full-wave rectifying circuit 51 and the half-wave rectifying circuit 52 is longer than a period of negative polarity voltage of the pulse train output from the trans circuit 50 to the full-wave rectifying circuit 51 and the half-wave rectifying circuit 52. Thus, fluctuations in the second voltage that is output from the half-wave rectifying circuit 52 can be reduced.

Hereunder, a method of driving the lens electrode and the grid electrode 26 from a state in which a predetermined voltage is applied to the filament 25, a first voltage is applied to the lens electrode 27 and the grid electrode 26, and a predetermined high voltage is applied to the transmission type target 24 is described. In this connection, it is assumed that an X-ray irradiation period is 10 ms, and the X-ray generating apparatus 11 irradiates X-rays only one time (single-shot irradiation) in response to an instruction to irradiate X-rays from the control unit 13. In this case, the X-ray irradiation period can be controlled by means of the pulse width of a second voltage that is applied in a pulse form to the grid electrode 26.

As shown in FIG. 6, at a time of irradiating X-rays, the control circuit unit 42 first turns the transistors Q2 and Q3 of the inverter circuit 49 on, and turns the transistors Q1 and Q4 off. In this case, it is assumed that an "on" time period Ta1 of the transistors Q2 and Q3 is 1 ms. Further, taking into account a load produced by the full-wave rectifying circuit 51 and the lens electrode 27, a rise time of the second voltage that is supplied to the lens electrode 27 is estimated as 0.4 ms, and a time required until the second voltage stabilizes is estimated as 0.6 ms.

In the period Ta1, as shown by c in FIG. 6, a negative polarity voltage is output from the inverter circuit 49, and as shown by d and e in FIG. 6, negative polarity voltages are output from the trans circuit 50. As shown by f in FIG. 6, the full-wave rectifying circuit 51 inverts the negative polarity voltage that is output from the trans circuit 50, and as shown by h in FIG. 6, the voltage is smoothed by the smoothing capacitor 57 and supplied to the lens electrode 27. Meanwhile, as shown by g in FIG. 6, the half-wave rectifying circuit 52 blocks the negative polarity voltage output from the trans circuit 50, and as shown by i in FIG. 6, maintains the output voltage with respect to the grid electrode 26 at the first voltage.

Next, the control circuit unit 42 turns the transistors Q1 and Q4 of the inverter circuit 49 on, and turns the transistors Q2 and Q3 off. From this stage, the second voltage is also applied to the grid electrode 26. In this case, it is assumed that an "on" time period Ta2 of the transistors Q1 and Q4 is 2.2 ms. Further, taking into account a load produced by the half-wave rectifying circuit 52 and the grid electrode 26, a rise time of the second voltage that is supplied to the grid electrode 26 is estimated as 0.2 ms. In this case, a second voltage applying time period with respect to the grid electrode 26 is 2.0 ms, and an actual X-ray irradiation period can be estimated as 2.05 ms.

In the period Ta2, as shown by c in FIG. 6, a positive polarity voltage is output from the inverter circuit 49, and as shown by d and e in FIG. 6, positive polarity voltages are output from the trans circuit 50. As shown by f in FIG. 6, the full-wave rectifying circuit 51 outputs the positive polarity voltage that is output from the trans circuit 50 as it is, and as shown by h in FIG. 6, the voltage is smoothed by the smoothing capacitor 57 and supplied to the lens electrode 27. Meanwhile, as shown by g in FIG. 6, the half-wave rectifying circuit 52 outputs the positive polarity voltage that is output from the trans circuit 50 as it is, and as shown by i in FIG. 6, the voltage is smoothed by the smoothing capacitor 59 and supplied to the grid electrode 26.

Next, the control circuit unit 42 turns on the transistors Q2 and Q3 of the inverter circuit 49 and turns off the transistors Q1 and Q4. In this case, an "on" time period Tb1 of the transistors Q2 and Q3 is 0.2 ms.

In the period Tb1, as shown by c in FIG. 6, a negative polarity voltage is output from the inverter circuit 49, and as shown by d and e in FIG. 6, negative polarity voltages are output from the trans circuit 50. As shown by f in FIG. 6, the full-wave rectifying circuit 51 inverts the negative polarity voltage that is output from the trans circuit 50, and as shown by h in FIG. 6, the voltage is smoothed by the smoothing capacitor 57 and supplied to the lens electrode 27. Meanwhile, as shown by g in FIG. 6, since the half-wave rectifying circuit 52 blocks the negative polarity voltage output from the trans circuit 50, a charge that is accumulated in the smoothing capacitor 59 in the period Ta2 is discharged by the capacitor discharging resistor 64. Accordingly, as shown by i in FIG. 6, an output voltage with respect to the grid electrode 26 falls from the second voltage to approximately the first voltage within the period Tb1. An X-ray irradiation period during a fall time period caused by the smoothing capacitor 59 discharging is estimated as 0.05 ms.

Next, the control circuit unit 42 turns the transistors Q1 and Q4 of the inverter circuit 49 on, and turns the transistors Q2 and Q3 off. In this case, similarly to the period Ta2, an "on" time period Tb2 of the transistors Q1 and Q4 is 2.2 ms.

Further, taking into account a load produced by the half-wave rectifying circuit 52 and the grid electrode 26, a rise time of the second voltage that is supplied to the grid electrode 26 is estimated as 0.2 ms. In this case, the second voltage applying time period with respect to the grid electrode 26 is 2.0 ms, and the actual X-ray irradiation period can be estimated as 2.05 ms.

In the period Tb2, similarly to the period Ta2, as shown by c in FIG. 6, a positive polarity voltage is output from the inverter circuit 49, and as shown by d and e in FIG. 6, positive polarity voltages are output from the trans circuit 50. As shown by f in FIG. 6, the full-wave rectifying circuit 51 outputs the positive polarity voltage that is output from the trans circuit 50 as it is, and as shown by h in FIG. 6, the voltage is smoothed by the smoothing capacitor 57 and supplied to the lens electrode 27. Meanwhile, as shown by g in FIG. 6, the half-wave rectifying circuit 52 outputs the positive polarity voltage that is output from the trans circuit 50 as it is, and as shown by i in FIG. 6, the voltage is smoothed by the smoothing capacitor 59 and supplied to the grid electrode 26.

Thereafter, the control circuit unit 42 turns the transistors Q1 to Q4 of the inverter circuit 49 on/off sequentially in the same manner as in the above described period Tb1 and period Tb2 to supply the second voltage to the lens electrode 27 by means of the full-wave rectifying circuit 51 and supply the second voltage to the grid electrode 26 by means of the half-wave rectifying circuit 52.

As described above, according to the present embodiment, a single irradiation period of X-rays is set to 10 ms, the period Tb1 is set to 0.2 ms, and the period Tb2 is set to 2.0 ms. Therefore, at a time of irradiating X-rays, the second voltage supplied to the grid electrode 26 is generated by a pulse train of five cycles that is output from the inverter circuit 49. In this case, a length of a first cycle to a fourth cycle of the pulse train that is output from the inverter circuit 49 is equal to the length of the aforementioned periods Tb2 and Tb1, respectively, and only a length of a fifth cycle is different.

When generating a pulse of the fifth cycle, the control circuit unit 42 turns the transistors Q1 and Q4 of the inverter circuit 49 on, and turns the transistors Q2 and Q3 off. An "on" time period Te1 of the transistors Q1 and Q4 at this time is 1.7 ms. Further, taking into account a load produced by the half-wave rectifying circuit 52 and the grid electrode 26, a rise time of the second voltage that is supplied to the grid electrode 26 is estimated as 0.2 ms, and a second voltage applying time period with respect to the grid electrode 26 is 1.5 ms. This is because the sum total of actual X-ray irradiation periods in the first to fourth cycles of the pulse train that is output from the inverter circuit 49 is 8.4 ms, and an estimated actual X-ray irradiation period during a fall time thereafter can be estimated as 0.05 ms, and hence the actual irradiation period during the period Te1 can be estimated as 1.55 ms.

In the period Te1, similarly to the period Ta2, as shown by c in FIG. 6, a positive polarity voltage is output from the inverter circuit 49, and as shown by d and e in FIG. 6, positive polarity voltages are output from the trans circuit 50. As shown by f in FIG. 6, the full-wave rectifying circuit 51 outputs the positive polarity voltage that is output from the trans circuit 50 as it is, and as shown by h in FIG. 6, the voltage is smoothed by the smoothing capacitor 57 and supplied to the lens electrode 27. Meanwhile, as shown by g in FIG. 6, the half-wave rectifying circuit 52 outputs the positive polarity voltage that is output from the trans circuit 50 as it is, and as shown by i in FIG. 6, the voltage is smoothed by the smoothing capacitor 59 and supplied to the grid electrode 26.

At the time of a last operation during the X-ray irradiation period, the control circuit unit 42 turns the transistors Q2 and Q3 of the inverter circuit 49 on and turns the transistors Q1 and Q4 off. In this case, taking into account a fall time of the applied voltage with respect to the grid electrode 26 that ends immediately prior thereto, the "on" time period Te2 of the transistors Q2 and Q3 is set to 2 ms so that electrons emitted from the electron source 21 can be definitely focused by the lens electrode 27.

In the period Te2, as shown by c in FIG. 6, a negative polarity voltage is output from the inverter circuit 49, and as shown by d and e in FIG. 6, negative polarity voltages are output from the trans circuit 50. As shown by f in FIG. 6, the full-wave rectifying circuit 51 inverts the negative polarity voltage that is output from the trans circuit 50, and as shown by h in FIG. 6, the voltage is smoothed by the smoothing capacitor 57 and supplied to the lens electrode 27. Meanwhile, as shown by g in FIG. 6, since the half-wave rectifying circuit 52 blocks the negative polarity voltage output from the trans circuit 50, as shown by i in FIG. 6, the output voltage with respect to the grid electrode 26 decreases from the second voltage to the first voltage. An X-ray irradiation period during the fall time period that is caused by the smoothing capacitor 59 discharging electricity is estimated as 0.05 ms.

Finally, at a time point at which the applied voltage to the lens electrode 27 has definitely fallen, the control circuit unit 42 stops application of a voltage to the transmission type target 24, and stops application of a voltage to the filament 25 of the electron source 21 to end the X-ray irradiation operation.

In this connection, as described above, the number of pulses and the pulse width of a pulse train output from the inverter circuit 49 can be determined by taking into account a previously set X-ray irradiation period, load characteristics of the grid electrode 26 and the lens electrode 27, as well as characteristics of each rectifying circuit.

Further, although according to the present embodiment the operations of the lens electrode and grid electrode driving unit 44 have been described based on an example of single-shot irradiation in which X-rays are irradiated only one time in response to an instruction to irradiate X-rays from the control unit 13, in a case of continuous irradiation in which X-rays are irradiated continuously in response to an instruction to irradiate X-rays from the control unit 13 also, the continuous irradiation can be realized by repeating the above described single-shot irradiation operations.

According to the X-ray generating apparatus of the present embodiment, by configuring the lens electrode and grid electrode driving unit 44 that generates voltages that are supplied to the lens electrode 27 and the grid electrode 26 in a manner in which the inverter circuit 49 is shared, the circuit scale of a drive circuit that generates voltages applied to each electrode of the X-ray tube 20 can be made smaller than in the related art. Accordingly, the X-ray generating apparatus can also be made smaller than in the related art.

(Second Embodiment)

Next, a second embodiment of the X-ray generating apparatus according to the present invention is described.

In the X-ray generating apparatus of the second embodiment, voltages that are applied to the grid electrode and the cathode electrode 34 of the X-ray tube 20 illustrated in FIG. 2 are different to the first embodiment. More specifically, the X-ray generating apparatus of the second embodiment is provided with a function whereby, instead of the grid electrode 26 shown in FIG. 2, electrons are drawn out from the filament 25 by the cathode electrode 34. A predetermined reference voltage (for example, −50 kV) that regulates the potential of the electron source 21 is applied to the grid electrode 26.

Further, according to an X-ray generating apparatus 11 of the present embodiment, based on the potential of the grid electrode 26, a predetermined voltage is supplied to the filament 25, the cathode electrode 34, the lens electrode 27 and the transmission type target 24, respectively.

A first voltage that is a voltage that does not cause electrons to be emitted from the electron source 21 or a second voltage that is a voltage for causing electrons to be emitted from the electron source 21 is applied to the cathode electrode 34. The first voltage is a voltage that has the same potential as the electron source 21 or a higher potential (positive voltage) than the electron source 21. The second voltage is a voltage that has a lower potential than the electron source 21. According to the present embodiment, the potential of the electron source 21 is the same potential as the grid electrode 26 as described above.

Similarly to the first embodiment, a first voltage that is a voltage that does not produce a lens action or a second voltage that is a voltage that produces a lens action is applied to the lens electrode 27. The first voltage is a voltage that has the same potential as the electron source 21 or a lower potential (negative voltage) than the electron source 21. The second voltage is a voltage that has a higher potential than the electron source 21.

Similarly to the first embodiment, a predetermined high voltage (for example, a DC voltage of 100 kV) based on the potential of the electron source 21 is applied to the transmission type target 24. The configuration of the X-ray tube 20 and the X-ray imaging apparatus 10 are the same as in the first embodiment, and hence a description thereof is omitted here.

Figure 7:
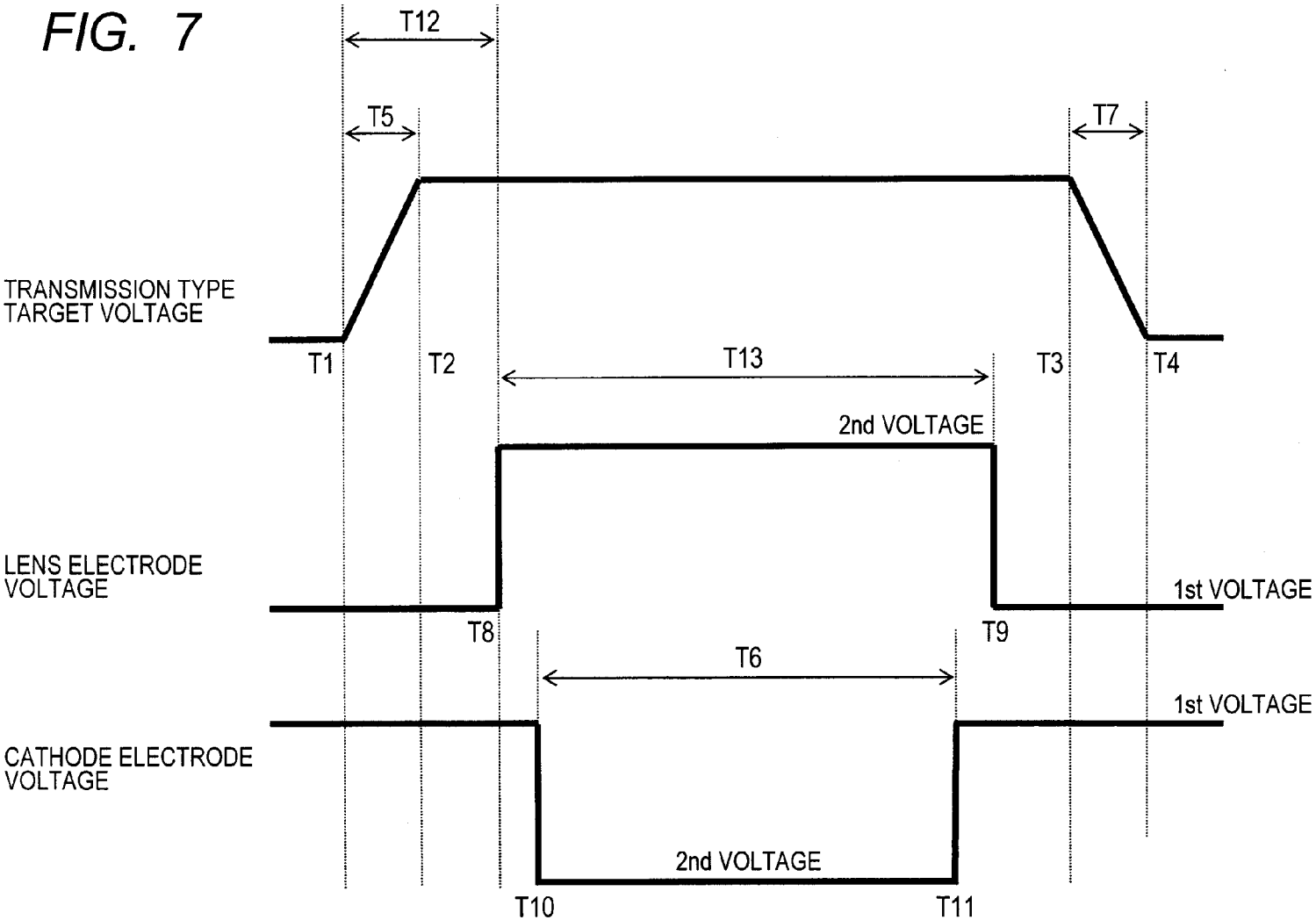
FIG. 7 is a waveform diagram that illustrates an example of a method of driving an X-ray tube according to a second embodiment.

First, a method of driving an X-ray tube according to the second embodiment is described using FIG. 7.

FIG. 7 is a waveform diagram that illustrates an example of the method of driving an X-ray tube according to the second embodiment.

FIG. 7 illustrates the timing of applying a high voltage to the transmission type target 24, and the timing of applying a first voltage and a second voltage to the cathode electrode 34 and the lens electrode 27, respectively. Emission of electrons and stopping emission of electrons from the electron source 21 is controlled by means of an applied voltage to the cathode electrode 34. In this connection, the lateral direction in FIG. 7 represents a time axis. Applied voltages to the transmission type target 24, the lens electrode 27 and the cathode electrode 34 shown in FIG. 7 are controlled by means of the X-ray power source driving unit 15 in accordance with an instruction of the control unit 13 shown in FIG. 1.

For example, when the main power source of the X-ray imaging apparatus 10 is turned on, the control unit 13 applies a first voltage to the cathode electrode 34 and applies a first voltage to the lens electrode 27 by means of the X-ray power source driving unit 15. Further, the control unit 13 applies a predetermined voltage to the filament 25 to heat the filament 25 in advance so that thermal electrons are stably emitted from the electron source 21 when generating X-rays. Heating of the filament is started prior to starting application of a high voltage to the transmission type target 24, and heating of the filament 25 is stopped after stopping application of the high voltage to the transmission type target 24.

As shown in FIG. 7, first, at a time point T1, the control unit 13 applies a high voltage (predetermined voltage) to the transmission type target 24 by means of the X-ray power source driving unit 15. Time is required from the start of applying a voltage to the transmission type target 24 until the applied voltage reaches a predetermined high voltage (period T5). The control unit 13 can hold information regarding the period T5 in advance, and can determine the application timing with respect to the lens electrode 27 and the cathode electrode 34. The voltage applied to the transmission type target 24 reaches the predetermined high voltage at a time point T2.

When the applied voltage of the transmission type target 24 reaches the predetermined high voltage, at a time point T8, the control unit 13 applies a second voltage to the lens electrode 27 by means of the X-ray power source driving unit 15. Next, at a time point T10, the control unit 13 applies the second voltage to the cathode electrode 34 to cause the emission of electrons from the electron source 21 and generate X-rays in the X-ray tube 20.

When a required X-ray generating period (period T6) elapses, at a time point T11, the control unit 13 switches the applied voltage of the cathode electrode 34 from the second voltage to the first voltage by means of the X-ray power source driving unit 15 to stop emission of electrons from the electron source 21. Next, at a time point T9, the control unit 13 switches the applied voltage of the lens electrode 27 from the second voltage to the first voltage. Thereafter, at a time point T3, the control unit 13 stops application of a voltage to the transmission type target 24. At such time, the time point when the applied voltage of the transmission type target 24 actually returns to the original voltage (potential of the electron source 21) is a time point T4.

In this case, although a voltage is applied to the transmission type target 24 in the period T5 (T1 to T2), X-rays are not generated because electrons are not emitted from the electron source 21. In contrast, in the period T6 (T10 to T11), since the predetermined high voltage is applied to the transmission type target 24 and the second voltage is applied to the lens electrode 27 and the cathode electrode 34, X-rays are emitted from the X-ray transmission window 28. The period T6 is set to, for example, a period of approximately 10 msec to 1 sec. Since the emission of electrons from the electron source 21 stops at the time point T11, the time point T3 (timing of stopping application of a voltage to the transmission type target 24) may be set to a time point from the time point T11 onward.

As described above, when the second voltage is applied to the cathode electrode 34 between the time point T1 and the time point T2, electrons emitted from the electron source 21 collide with the lens electrode 27 and the rearward shielding member 22, and unwanted X-rays are generated. However, even in that case, if the second voltage is applied to the lens electrode 27, since most of the electrons do not collide with the rearward shielding member 22, generation of unwanted X-rays is suppressed. Therefore, unwanted X-rays do not leak to outside of the vacuum container 29.

Further, when the first voltage that is applied to the lens electrode 27 is set lower than the potential of the electron source 21, even if the second voltage is applied to the cathode electrode 34 between the time point T1 and the time point T2, electrons emitted from the electron source 21 are returned to the electron source 21 side by the lens electrode 27. Accordingly, in that case also, generation of unwanted X-rays is suppressed.

Figure 8:
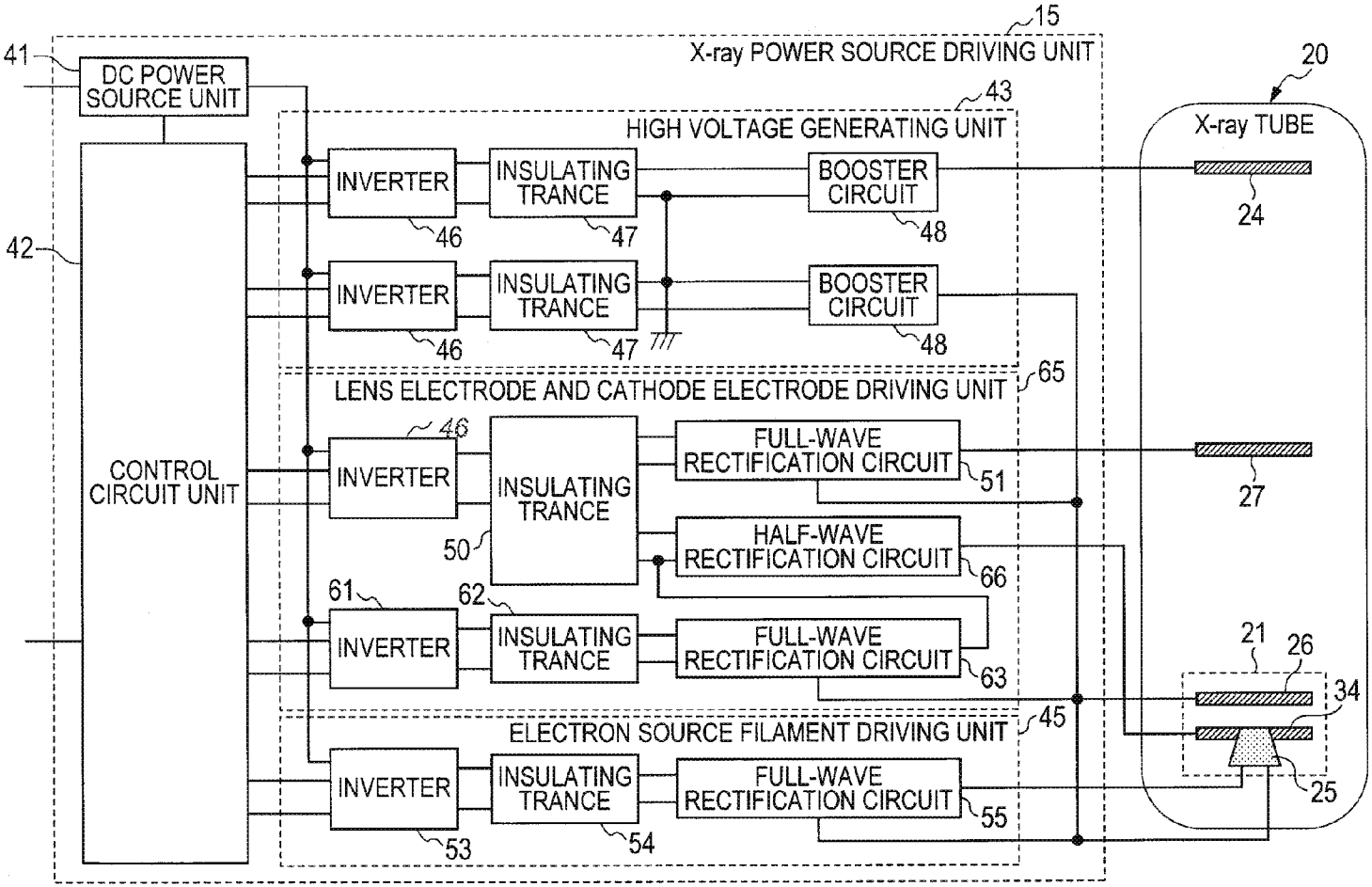
FIG. 8 is a block diagram that illustrates a configuration example of an X-ray generating apparatus according to the second embodiment.

Next, the configuration of the X-ray generating apparatus according to the second embodiment is described using FIG. 8.

FIG. 8 is a block diagram that illustrates a configuration example of the X-ray generating apparatus according to the second embodiment.

As shown in FIG. 8, the X-ray generating apparatus 11 includes the X-ray power source driving unit 15 and the X-ray tube 20.

The X-ray power source driving unit 15 includes a DC power source unit 41, a control circuit unit 42, a high voltage generating unit 43, a lens electrode and cathode electrode driving unit 65 and an electron source filament driving unit 45.

The DC power source unit 41 receives electric power from an external DC power supply or AC power supply, and supplies a predetermined DC voltage to the control circuit unit 42, the high voltage generating unit 43, the lens electrode and cathode electrode driving unit 65 and the electron source filament driving unit 45.

In accordance with instructions from the control unit 13 (see FIG. 1), the control circuit unit 42 controls operations of the high voltage generating unit 43, the lens electrode and cathode electrode driving unit 65 and the electron source filament driving unit 45.

The high voltage generating unit 43 includes inverter circuits 46, trans circuits 47 and booster circuits 48, and generates a DC voltage (approximately ±50 kV) that takes the potential of the electron source 21 as a reference potential (for example, −50 kV), that is supplied to the transmission type target 24. In accordance with control performed by the control circuit unit 42, each inverter circuit 46, for example, converts a DC voltage supplied from the DC power source unit 41 into an AC voltage with a frequency from several kHz to several tens of kHz and a peak voltage of approximately 100 V. An AC voltage output from the inverter circuit 46 is supplied to the booster circuit 48 through the trans circuit 47. The booster circuit 48 boosts the AC voltage that is output from the inverter circuit 46, and converts the AC voltage to a DC voltage of approximately 100 kV. The output voltage of the booster circuit 48 is supplied to the transmission type target 24 and the grid electrode 26.

The lens electrode and cathode electrode driving unit 65 includes inverter circuits 49 and 61, trans circuits 50 and 62, full-wave rectifying circuits 51 and 63 and a half-wave rectifying circuit 66. The lens electrode and cathode electrode driving unit 65 generates DC voltages (first voltage and second voltage) that take the potential of the electron source 21 as a reference potential (for example, −50 kV), that are supplied to the lens electrode 27 and the cathode electrode 34. The inverter circuit 49, the trans circuit 50, the full-wave rectifying circuit 51 and the half-wave rectifying circuit 66 generate a second voltage that is supplied to the lens electrode 27 and the cathode electrode 34. The inverter circuit 61, the trans circuit 62 and the full-wave rectifying circuit 63 generate a bias voltage for setting the output voltage of the half-wave rectifying circuit 66 to the first voltage when the second voltage is not being applied to the cathode electrode 34. Hereinafter, the inverter circuit 61, the trans circuit 62 and the full-wave rectifying circuit 63 are referred to as a "bias circuit". The first voltage that is supplied to the lens electrode 27, for example, is set to the same potential as the electron source 21.

In accordance with control performed by the control circuit unit 42, the inverter circuit 49, for example, converts a DC voltage supplied from the DC power source unit 41 into an AC voltage (pulse train) with a frequency from several kHz to several tens of kHz and a peak voltage of approximately 100 V. A pulse train output from the inverter circuit 49 is input into the, for example, one-input, two-output type trans circuit 50 that receives the pulse train as an input and can output pulse trains of different voltages to the full-wave rectifying circuit 51 and the half-wave rectifying circuit 66. The trans circuit outputs a pulse train with a peak voltage of approximately 2 kV for the lens electrode 27, and outputs a pulse train with a peak voltage of approximately 200 V for the cathode electrode 34. In this connection, the trans circuit 50 is not limited to a one-input, two-output type trans circuit, and a configuration may be adopted in which two one-input, one-output type trans circuits 50 are provided in correspondence with the full-wave rectifying circuit 51 and the half-wave rectifying circuit 66. If a one-input, two-output type trans circuit is provided as the trans circuit 50, the circuit scale of the lens electrode and cathode electrode driving unit 65 can be made smaller.

The pulse train of approximately 2 kV for the lens electrode 27 is converted into a DC voltage of approximately 1 kV by the full-wave rectifying circuit 51, and is supplied as a second voltage to the lens electrode 27. The first voltage that is supplied to the lens electrode 27 may have the same potential as the cathode electrode 34 as described above. The first voltage that is supplied to the lens electrode 27 may also be set to a negative voltage by, for example, providing a circuit that is the same as the above described bias circuit, and adding a voltage generated in the bias circuit to the output voltage of the full-wave rectifying circuit 51.

The pulse train of approximately 200 V for the cathode electrode 34 is converted into a DC voltage of approximately −100 V by the half-wave rectifying circuit 66, and is supplied as a second voltage to the cathode electrode 34. The first voltage that is applied to the cathode electrode 34 is generated by generating a DC voltage of approximately 70 V by means of the aforementioned bias circuit, and adding that DC voltage to the output voltage of the half-wave rectifying circuit 66.

The inverter circuit 61 of the bias circuit, for example, converts a DC voltage supplied from the DC power source unit 41 to an AC voltage with a frequency from several kHz to several tens of kHz and a peak voltage of approximately 100 V. The AC voltage that is output from the inverter circuit 61 is converted to an AC voltage of approximately 140 V by the trans circuit 62. The AC voltage that is output from the trans circuit 62 is converted to a DC voltage of approximately 70 V by the full-wave rectifying circuit 63, and added to an output voltage of the half-wave rectifying circuit 66.

The electron source filament driving unit 45 includes an inverter circuit 53, a trans circuit 54 and a full-wave rectifying circuit 55, and generates a DC voltage of approximately 10 V that is supplied to the filament 25 of the electron source 21. In accordance with control of the control circuit unit 42, the inverter circuit 53, for example, converts a DC voltage supplied from the DC power source unit 41 to an AC voltage with a frequency from several kHz to several tens of kHz and a peak voltage of approximately 100 V. The AC voltage that is output from the inverter circuit 53 is converted to an AC voltage of approximately 20 V by the trans circuit 54. The AC voltage that is output from the trans circuit 54 is converted to a DC voltage of approximately 10 V by the full-wave rectifying circuit 55, and supplied to the filament 25 of the electron source 21.

Figure 9:
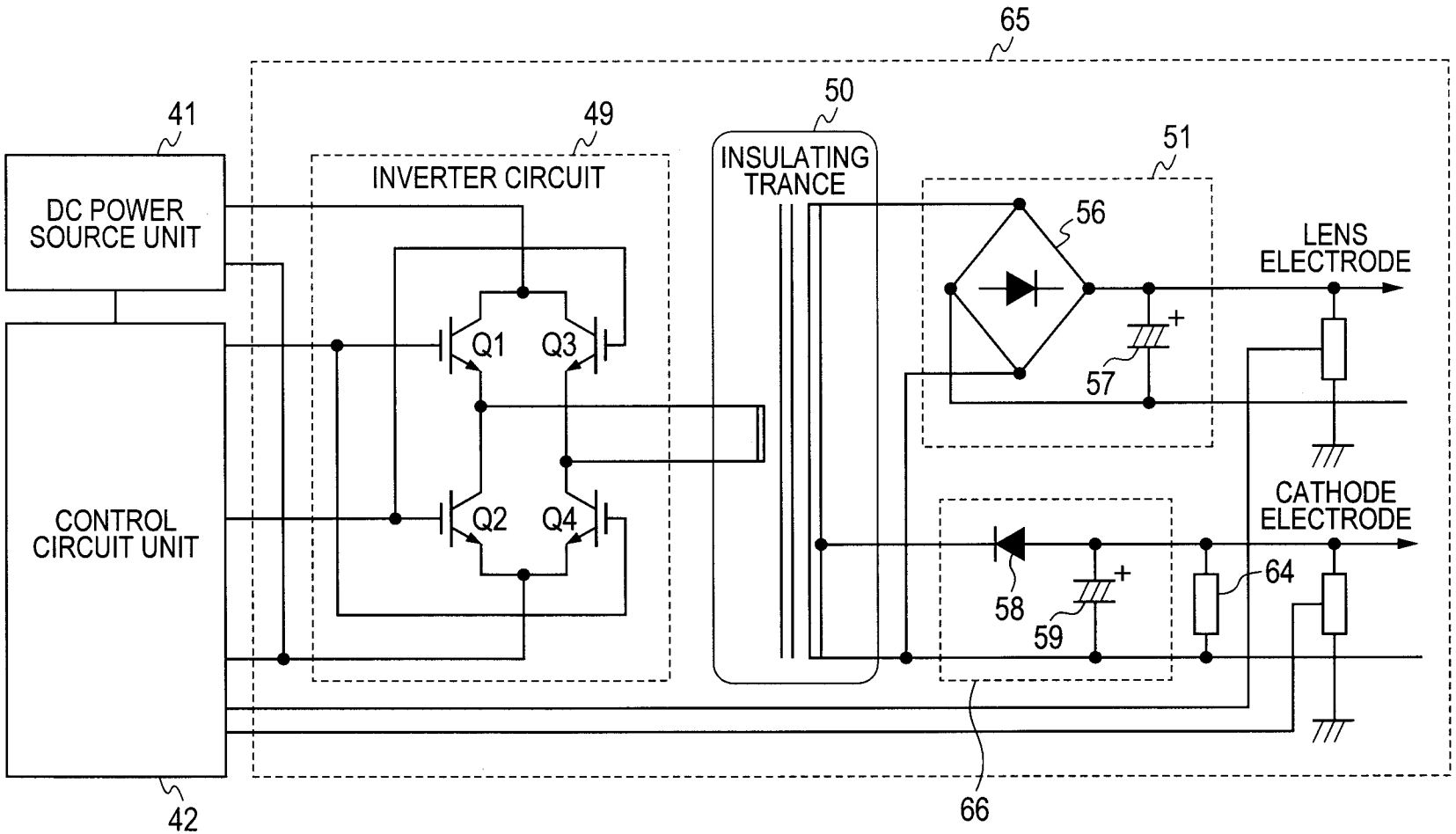
FIG. 9 is a circuit diagram that illustrates a configuration example of a lens electrode and cathode electrode driving unit shown in FIG. 8.

Next, a specific configuration example of the lens electrode and cathode electrode driving unit 65 illustrated in FIG. 8 is described using FIG. 9.

FIG. 9 is a circuit diagram that illustrates a configuration example of the lens electrode and cathode electrode driving unit 65 illustrated in FIG. 8.

As shown in FIG. 9, the inverter circuit 49 includes bridge-connected transistors Q1 to Q4. A DC voltage of approximately 100 V is supplied to the inverter circuit 49 from the DC power source unit 41. In the inverter circuit 49, the transistors Q1 and Q4 or the transistors Q2 and Q3 are controlled so as to turn on and off simultaneously by the control circuit unit 42. Further, in the inverter circuit 49, the transistors Q1 and Q2 and also the transistors Q3 and Q4 are controlled so as not to turn on simultaneously by the control circuit unit 42.

When the transistors Q1 and Q4 are on, a voltage of positive polarity (hereunder, referred to as "positive polarity voltage") is output from the inverter circuit 49. In contrast, when the transistors Q3 and Q2 are on, a voltage of negative polarity (hereunder, referred to as "negative polarity voltage") is output from the inverter circuit 49. Thus, the inverter circuit 49 converts a DC voltage of approximately 100 V that is supplied from the DC power source unit 41 to an AC voltage (pulse train) with an amplitude of approximately 100 V.

A pulse train that is output from the inverter circuit 49 is converted to, for example, a pulse train of approximately 2 kV for the lens electrode 27 and a pulse train of approximately 200 V for the cathode electrode 34 by the one-input, two-output trans circuit 50.

The full-wave rectifying circuit 51 includes a rectifying diode bridge circuit 56 and a smoothing capacitor 57, and converts the pulse train of approximately 2 kV that is output from the trans circuit 50 to a DC voltage of approximately 1 kV. The output voltage of the full-wave rectifying circuit 51 is supplied to the lens electrode 27 as a second voltage.

The half-wave rectifying circuit 66 includes a rectifying diode 58, a smoothing capacitor 59 and a capacitor discharging resistor 64, and converts the pulse train of approximately 200 V that is output from the trans circuit 50 to a DC voltage of approximately −100 V.

Figure 10:
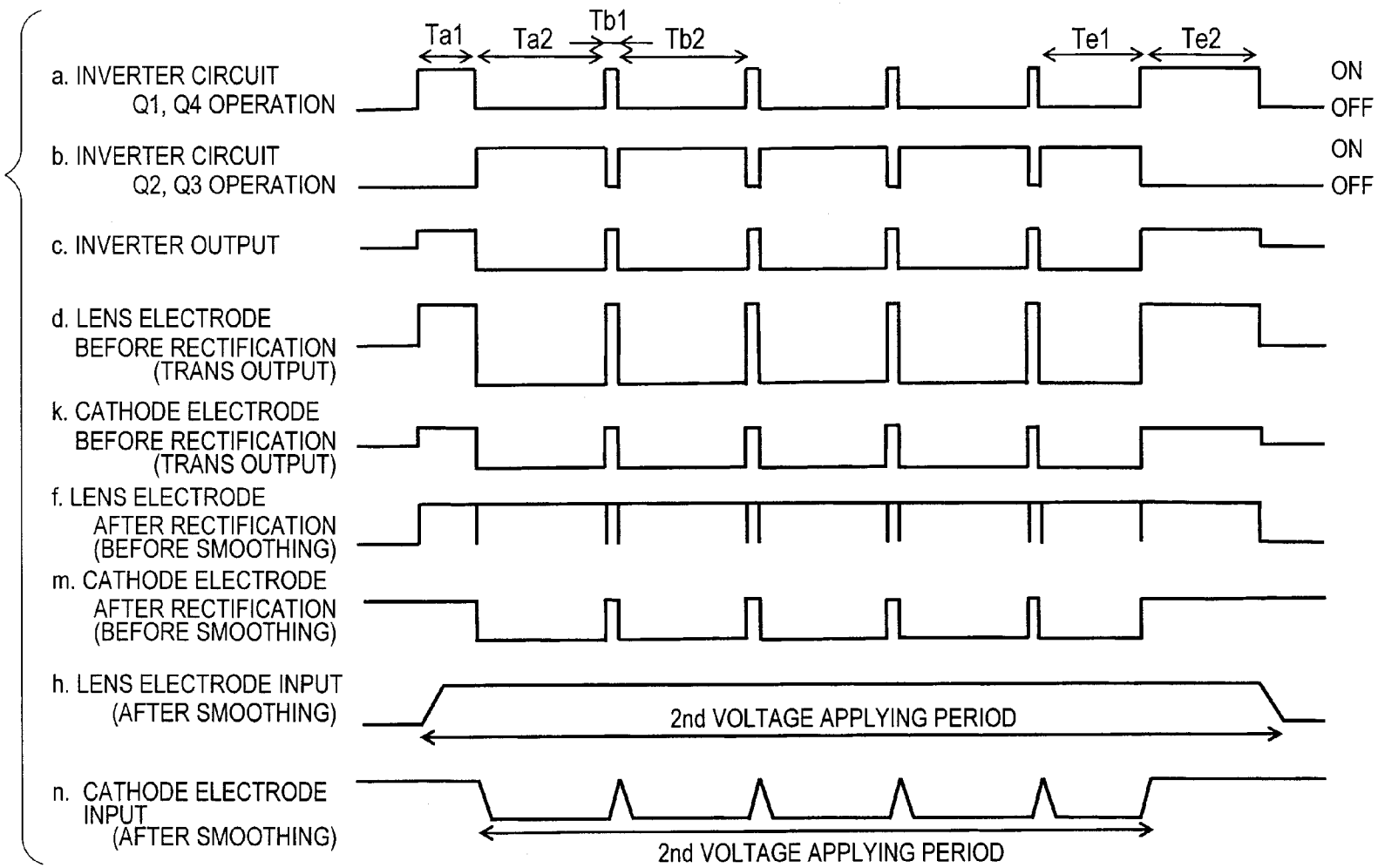
FIG. 10 is a waveform diagram that illustrates an example of operation waveforms of the lens electrode and cathode electrode driving unit shown in FIG. 8.

Next, the operations of the lens electrode and cathode electrode driving unit 65 of the present embodiment are described using FIG. 10.

FIG. 10 is a waveform diagram that illustrates an example of operation waveforms of the lens electrode and cathode electrode driving unit illustrated in FIG. 8.

As shown in FIG. 7, according to the present embodiment, at a time of irradiating X-rays, first, the second voltage is applied to the lens electrode 27 (T8), and thereafter the second voltage is applied to the cathode electrode 34 (T10). Further, when stopping X-ray irradiation, first, the voltage applied to the cathode electrode 34 is switched from the second voltage to the first voltage (T11), and thereafter the voltage applied to the lens electrode 27 is switched from the second voltage to the first voltage (T9).

As shown in FIG. 8, the lens electrode and cathode electrode driving unit 65 full-wave rectifies the pulse train that is output from the inverter circuit 49 and supplies the full-wave rectified pulse train to the lens electrode 27, and also half-wave rectifies the pulse train that is output from the inverter circuit 49 and supplies the half-wave rectified pulse train to the cathode electrode 34. According to the present invention, the period from T8 to T10 and the period from T11 to T9 that are described above are secured by utilizing this difference in the rectifying systems. More specifically, at times of a first operation and a last operation of the inverter circuit 49 during a period of generating X-rays, the control circuit unit 42 controls operations of the inverter circuit 49 so as to output a voltage of positive polarity to the full-wave rectifying circuit 51 and the half-wave rectifying circuit 66, respectively, from the trans circuit 50. Thus, a DC voltage (second voltage) can be output from the full-wave rectifying circuit 51 that rectifies by also utilizing a positive polarity voltage prior to the half-wave rectifying circuit 66 that rectifies without utilizing a positive polarity voltage. Further, the DC voltage that is output from the full-wave rectifying circuit 51 that rectifies by also utilizing a positive polarity voltage can be stopped after the DC voltage that is output from the half-wave rectifying circuit 66 that rectifies without utilizing a positive polarity voltage. More specifically, the second voltage can be applied to the lens electrode 27 prior to the cathode electrode 34, and the applied voltage of the lens electrode 27 can be switched from the second voltage to a first voltage after the cathode electrode 34. In this connection, the above described period from T8 to T10 and period from T11 to T9 can be set with a pulse width of the positive polarity voltage supplied to the full-wave rectifying circuit 51 and the half-wave rectifying circuit 66, respectively.

Further, according to the present embodiment, operations of the inverter circuit 49 are controlled such that, during a period of generating X-rays except for the above described period from T8 to T10 and period from T11 to T9, a period of negative polarity voltage of the pulse train output from the trans circuit 50 to the full-wave rectifying circuit 51 and the half-wave rectifying circuit 66 is longer than a period of positive polarity voltage of the pulse train output from the trans circuit 50 to the full-wave rectifying circuit 51 and the half-wave rectifying circuit 66. Thus, fluctuations in the second voltage that is output from the half-wave rectifying circuit 66 can be reduced.

Hereunder, a method of driving the lens electrode 27 and the cathode electrode 34 from a state in which a predetermined voltage is applied to the filament 25, a first voltage is applied to the lens electrode 27 and the cathode electrode 34, and a predetermined high voltage is applied to the transmission type target 24 is described. In this connection, it is assumed that an X-ray irradiation period is 10 ms, and the X-ray generating apparatus 11 irradiates X-rays only one time (single-shot irradiation) in response to an instruction to irradiate X-rays from the control unit 13. In this case, the X-ray irradiation period can be controlled by means of the pulse width of a second voltage that is applied in a pulse form to the cathode electrode 34.

As shown in FIG. 10, at a time of irradiating X-rays, the control circuit unit 42 first turns the transistors Q1 and Q4 of the inverter circuit 49 on, and turns the transistors Q2 and Q3 off. In this case, it is assumed that an "on" time period Ta1 of the transistors Q1 and Q4 is 1 ms. Further, taking into account a load produced by the full-wave rectifying circuit 51 and the lens electrode 27, a rise time of the second voltage that is supplied to the lens electrode 27 is estimated as 0.4 ms, and a time required until the second voltage stabilizes is estimated as 0.6 ms.

In the period Ta1, as shown by c in FIG. 10, a positive polarity voltage is output from the inverter circuit 49, and as shown by d and k in FIG. 10, positive polarity voltages are output from the trans circuit 50. As shown by f in FIG. 10, the full-wave rectifying circuit 51 outputs the positive polarity voltage that is output from the trans circuit 50 as it is, and as shown by h in FIG. 10, the voltage is smoothed by the smoothing capacitor 57 and supplied to the lens electrode 27. Meanwhile, as shown by m in FIG. 10, the half-wave rectifying circuit 66 blocks the positive polarity voltage output from the trans circuit 50, and as shown by n in FIG. 10, maintains the output voltage with respect to the cathode electrode 34 at the first voltage.

Next, the control circuit unit 42 turns the transistors Q2 and Q3 of the inverter circuit 49 on, and turns the transistors Q1 and Q4 off. From this stage, the second voltage is also applied to the cathode electrode 34. In this case, it is assumed that an "on" time period Ta2 of the transistors Q2 and Q3 is 2.2 ms. Further, taking into account a load produced by the half-wave rectifying circuit 66 and the cathode electrode 34, a rise time of the second voltage that is supplied to the cathode electrode 34 is estimated as 0.2 ms. In this case, a second voltage applying time period with respect to the cathode electrode 34 is 2.0 ms, and an actual X-ray irradiation period can be estimated as 2.05 ms.

In the period Ta2, as shown by c in FIG. 10, a negative polarity voltage is output from the inverter circuit 49, and as shown by d and k in FIG. 10, negative polarity voltages are output from the trans circuit 50. As shown by f in FIG. 10, the full-wave rectifying circuit 51 inverts and outputs the negative polarity voltage that is output from the trans circuit 50, and as shown by h in FIG. 10, the voltage is smoothed by the smoothing capacitor 57 and supplied to the lens electrode 27. Meanwhile, as shown by m in FIG. 10, the half-wave rectifying circuit 66 outputs the negative polarity voltage that is output from the trans circuit 50 as it is, and as shown by n in FIG. 10, the voltage is smoothed by the smoothing capacitor 59 and supplied to the cathode electrode 34.

Next, the control circuit unit 42 turns on the transistors Q1 and Q4 of the inverter circuit 49 and turns off the transistors Q2 and Q3. In this case, an "on" time period Tb1 of the transistors Q1 and Q4 is 0.2 ms.

In the period Tb1, as shown by c in FIG. 10, a positive polarity voltage is output from the inverter circuit 49, and as shown by d and k in FIG. 10, positive polarity voltages are output from the trans circuit 50. As shown by f in FIG. 10, the full-wave rectifying circuit 51 outputs the positive polarity voltage that has been output from the trans circuit 50 as it is, and as shown by h in FIG. 10, the voltage is smoothed by the smoothing capacitor 57 and supplied to the lens electrode 27. Meanwhile, as shown by m in FIG. 10, since the half-wave rectifying circuit 66 blocks the positive polarity voltage output from the trans circuit 50, a charge that is accumulated in the smoothing capacitor 59 in the period Ta2 is discharged by the capacitor discharging resistor 64. Accordingly, as shown by n in FIG. 10, an output voltage with respect to the cathode electrode 34 rises from the second voltage to approximately the first voltage within the period Tb1. An X-ray irradiation period during a rise time period caused by the smoothing capacitor 59 discharging is estimated as 0.05 ms.

Next, the control circuit unit 42 turns the transistors Q2 and Q3 of the inverter circuit 49 on, and turns the transistors Q1 and Q4 off. In this case, similarly to the period Ta2, an "on" time period Tb2 of the transistors Q2 and Q3 is 2.2 ms.

Further, taking into account a load produced by the half-wave rectifying circuit 66 and the cathode electrode 34, a fall time of the second voltage that is supplied to the cathode electrode 34 is estimated as 0.2 ms. In this case, the second voltage applying time period with respect to the cathode electrode 34 is 2.0 ms, and the actual X-ray irradiation period can be estimated as 2.05 ms.

In the period Tb2, similarly to the period Ta2, as shown by c in FIG. 10, a negative polarity voltage is output from the inverter circuit 49, and as shown by d and k in FIG. 10, negative polarity voltages are output from the trans circuit 50. As shown by f in FIG. 10, the full-wave rectifying circuit 51 inverts and outputs the negative polarity voltage that is output from the trans circuit 50, and as shown by h in FIG. 10, the voltage is smoothed by the smoothing capacitor 57 and supplied to the lens electrode 27. Meanwhile, as shown by m in FIG. 10, the half-wave rectifying circuit 66 outputs the negative polarity voltage that is output from the trans circuit 50 as it is, and as shown by n in FIG. 10, the voltage is smoothed by the smoothing capacitor 59 and supplied to the cathode electrode 34.

Thereafter, the control circuit unit 42 turns the transistors Q1 to Q4 of the inverter circuit 49 on/off sequentially in the same manner as in the above described period Tb1 and period Tb2 to supply the second voltage to the lens electrode 27 by means of the full-wave rectifying circuit 51 and supply the second voltage to the cathode electrode 34 by means of the half-wave rectifying circuit 66.

As described above, according to the present embodiment, a single irradiation period of X-rays is set to 10 ms, the period Tb1 is set to 0.2 ms, and the period Tb2 is set to 2.0 ms. Therefore, at a time of irradiating X-rays, the second voltage supplied to the cathode electrode 34 is generated by a pulse train of five cycles that is output from the inverter circuit 49. In this case, a length of a first cycle to a fourth cycle of the pulse train that is output from the inverter circuit 49 is equal to the length of the aforementioned periods Tb2 and Tb1, respectively, and only a length of a fifth cycle is different.

When generating a pulse of the fifth cycle, the control circuit unit 42 turns the transistors Q2 and Q3 of the inverter circuit 49 on, and turns the transistors Q1 and Q4 off. An "on" time period Te1 of the transistors Q2 and Q3 at this time is 1.7 ms. Further, taking into account a load produced by the half-wave rectifying circuit 66 and the cathode electrode 34, a fall time of the second voltage that is supplied to the cathode electrode 34 is estimated as 0.2 ms, and a second voltage applying time period with respect to the cathode electrode 34 is 1.5 ms. This is because the sum total of actual X-ray irradiation periods in the first to fourth cycles of the pulse train that is output from the inverter circuit 49 is 8.4 ms, and an estimated actual X-ray irradiation period during a rise time thereafter can be estimated as 0.05 ms, and hence the actual irradiation period during the period Te1 can be estimated as 1.55 ms.

In the period Te1, similarly to the period Ta2, as shown by c in FIG. 10, a negative polarity voltage is output from the inverter circuit 49, and as shown by d and k in FIG. 10, negative polarity voltages are output from the trans circuit 50. As shown by f in FIG. 10, the full-wave rectifying circuit 51 inverts and outputs the negative polarity voltage that is output from the trans circuit 50, and as shown by h in FIG. 10, the voltage is smoothed by the smoothing capacitor 57 and supplied to the lens electrode 27. Meanwhile, as shown by m in FIG. 10, the half-wave rectifying circuit 66 outputs the negative polarity voltage that is output from the trans circuit 50 as it is, and as shown by n in FIG. 10, the voltage is smoothed by the smoothing capacitor 59 and supplied to the cathode electrode 34.

At the time of a last operation during the X-ray irradiation period, the control circuit unit 42 turns the transistors Q1 and Q4 of the inverter circuit 49 on and turns the transistors Q2 and Q3 off. In this case, taking into account a rise time of the applied voltage with respect to the cathode electrode 34 that ends immediately prior thereto, the "on" time period Te2 of the transistors Q1 and Q4 is set to 2 ms so that electrons emitted from the electron source 21 can be definitely focused by the lens electrode 27.

In the period Te2, as shown by c in FIG. 10, a positive polarity voltage is output from the inverter circuit 49, and as shown by d and k in FIG. 10, positive polarity voltages are output from the trans circuit 50. As shown by f in FIG. 10, the full-wave rectifying circuit 51 outputs the positive polarity voltage that is output from the trans circuit 50 as it is, and as shown by h in FIG. 10, the voltage is smoothed by the smoothing capacitor 57 and supplied to the lens electrode 27. Meanwhile, as shown by m in FIG. 10, since the half-wave rectifying circuit 66 blocks the negative polarity voltage output from the trans circuit 50, as shown by n in FIG. 10, the output voltage with respect to the cathode electrode 34 rises from the second voltage to the first voltage. An X-ray irradiation period during a rise time period that is caused by the smoothing capacitor 59 discharging is estimated as 0.05 ms.

Finally, at a time point at which the applied voltage to the lens electrode 27 has definitely fallen, the control circuit unit 42 stops application of a voltage to the transmission type target 24, and stops application of a voltage to the filament 25 of the electron source 21 to end the X-ray irradiation operation.

In this connection, as described above, the number of pulses and the pulse width of a pulse train output from the inverter circuit 49 can be determined by taking into account a previously set X-ray irradiation period, load characteristics of the cathode electrode 34 and the lens electrode 27, as well as characteristics of each rectifying circuit.

Further, although according to the present embodiment the operations of the lens electrode and cathode electrode driving unit 65 have been described based on an example of single-shot irradiation in which X-rays are irradiated only one time in response to an instruction to irradiate X-rays from the control unit 13, in a case of continuous irradiation in which X-rays are irradiated continuously in response to an instruction to irradiate X-rays from the control unit 13 also, the continuous irradiation can be realized by repeating the above described single-shot irradiation operations.

According to the X-ray generating apparatus of the present embodiment, by configuring the lens electrode and cathode electrode driving unit 65 that generates voltages that are supplied to the lens electrode 27 and the cathode electrode 34 in a manner in which the inverter circuit 49 is shared, the circuit scale of a drive circuit that generates voltages applied to each electrode of the X-ray tube 20 can be made smaller than in the related art. Accordingly, the X-ray generating apparatus can also be made smaller than in the related art.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-256793, filed Nov. 17, 2010, which is hereby incorporated by reference herein in its entirety.

What is claimed is:

1. An x-ray generating apparatus for generating an X-ray from a target by colliding an electron emitted from an electron source with the target through a grid electrode and a lens electrode comprising:

a DC power source unit for generating a predetermined DC voltage;

an inverter circuit for generating a pulse train based on the DC voltage outputted from the DC power source unit;

a trans circuit for converting a voltage of the pulse train into a predetermined voltage and outputting the converted pulse train;

a full-wave rectifying circuit for full-wave rectifying the pulse train outputted from the trans circuit, and supplying the full-wave rectified pulse train to the lens electrode;

a half-wave rectifying circuit for half-wave rectifying the pulse train outputted from the trans circuit, and supplying the half-wave rectified pulse train to the grid electrode; and a control circuit for controlling an operation of the inverter circuit such that the trans circuit outputs a negative polarity voltage to the full-wave rectifying circuit and the half-wave rectifying circuit at times of first and last operations of the inverter circuit during a period of generating the X-ray.

2. The x-ray generating apparatus according to claim 1, wherein the control circuit controls the operation of the inverter circuit such that, during a period except for the times of first and last operations of the inverter circuit during a period of generating the X-ray, a period of positive polarity voltage of the pulse train outputted from the trans circuit to the full-wave and half-wave rectifying circuits is longer than a period of negative polarity voltage of the pulse train outputted from the trans circuit to the full-wave and the half-wave rectifying circuits.

3. The x-ray generating apparatus according to claim 1, wherein the trans circuit is in one input and two outputs type, so as to input the pulse train generated by the inverter circuit, and to be capable of outputting pulse trains of different voltages respectively to the full-wave and half-wave rectifying circuits.

4. The x-ray generating apparatus according to claim 1, further comprising a bias circuit for generating a predetermined DC voltage for biasing the output voltage of the half-wave rectifying circuit.

5. An x-ray imaging apparatus comprising:

the x-ray generating apparatus according to claim 1;

an x-ray detecting unit for detecting an X-ray emitted from the x-ray generating apparatus and transmitted through an object;

a display unit for displaying an X-ray image of the object detected by the x-ray detecting unit; and a control unit for controlling operations of the x-ray generating apparatus, the x-ray detecting unit and the display unit.

6. An x-ray generating apparatus for generating an X-ray from a target by colliding an electron emitted from an electron source with the target through a cathode electrode and a lens electrode comprising:

a DC power source unit for generating a predetermined DC voltage;

an inverter circuit for generating a pulse train based on the DC voltage outputted from the DC power source unit;

a trans circuit for converting a voltage of the pulse train into a predetermined voltage and outputting the converted pulse train;

a full-wave rectifying circuit for full-wave rectifying the pulse train outputted from the trans circuit, and supplying the full-wave rectified pulse train to the lens electrode;

a half-wave rectifying circuit for half-wave rectifying the pulse train outputted from the trans circuit, and supplying the half-wave rectified pulse train to the cathode electrode; and a control circuit for controlling an operation of the inverter circuit such that the trans circuit outputs a positive polarity voltage to the full-wave rectifying circuit and the half-wave rectifying circuit at times of first and last operations of the inverter circuit during a period of generating the X-ray.

7. The x-ray generating apparatus according to claim 6, wherein the control circuit controls the operation of the inverter circuit such that, during a period except for the times of first and last operations of the inverter circuit during a period of generating the X-ray, a period of negative polarity voltage of the pulse train outputted from the trans circuit to the full-wave and half-wave rectifying circuits is longer than a period of positive polarity voltage of the pulse train outputted from the trans circuit to the full-wave and the half-wave rectifying circuits.

8. The x-ray generating apparatus according to claim 6, wherein the trans circuit is in one input and two outputs type, so as to input the pulse train generated by the inverter circuit, and to be capable of outputting pulse trains of different voltages respectively to the full-wave and half-wave rectifying circuits.

9. The x-ray generating apparatus according to claim 6, further comprising a bias circuit for generating a predetermined DC voltage for biasing the output voltage of the half-wave rectifying circuit.

10. An x-ray imaging apparatus comprising:

the x-ray generating apparatus according to claim 6;

an x-ray detecting unit for detecting an X-ray emitted from the x-ray generating apparatus and transmitted through an object;

a display unit for displaying an X-ray image of the object detected by the x-ray detecting unit; and a control unit for controlling operations of the x-ray generating apparatus, the x-ray detecting unit and the display unit.

11. A method of driving an X-ray tube which generates an X-ray from a target by colliding an electron emitted from an electron source with the target through a grid electrode and a lens electrode comprising step of:

generating a predetermined DC voltage;

generating a pulse train based on the DC voltage;

converting a voltage of the pulse train into a predetermined voltage and outputting the converted pulse train;

full-wave rectifying the converted pulse train, and supplying the full-wave rectified pulse train to the lens electrode;

half-wave rectifying the converted pulse train, and supplying the half-wave rectified pulse train to the grid electrode; and controlling the generating the pulse train such that, in the converting step, a negative polarity voltage is outputted in the full-wave rectifying step and the half-wave rectifying step at times of first and last operations in the step of generating the pulse train during a period of generating the X-ray.

12. A method of driving an X-ray tube which generates an X-ray from a target by colliding an electron emitted from an electron source with the target through a cathode electrode and a lens electrode comprising step of:

generating a predetermined DC voltage;

generating a pulse train based on the DC voltage;

converting a voltage of the pulse train into a predetermined voltage and outputting the converted pulse train;

full-wave rectifying the converted pulse train, and supplying the full-wave rectified pulse train to the lens electrode;

half-wave rectifying the converted pulse train, and supplying the half-wave rectified pulse train to the cathode electrode; and controlling the generating the pulse train such that, in the converting step, a positive polarity voltage is outputted in the full-wave rectifying step and the half-wave rectifying step at times of first and last operations in the step of generating the pulse train during a period of generating the X-ray.

* * * * *